US009976089B2

(12) United States Patent
Quanci et al.

(10) Patent No.: US 9,976,089 B2
(45) Date of Patent: May 22, 2018

(54) COKE OVEN CHARGING SYSTEM

(71) Applicant: SUNCOKE TECHNOLOGY AND DEVELOPMENT LLC, Lisle, IL (US)

(72) Inventors: John Francis Quanci, Haddonfield, NJ (US); Chun Wai Choi, Chicago, IL (US); Danny E. Sparling, Cedar Bluff, VA (US); Dexter Junior Mounts, Raven, VA (US); Mark Anthony Ball, Richlands, VA (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days. days.

(21) Appl. No.: 15/443,246

(22) Filed: Feb. 27, 2017

(65) Prior Publication Data

US 2017/0253804 A1 Sep. 7, 2017

Related U.S. Application Data

(63) Continuation of application No. 14/839,384, filed on Aug. 28, 2015, now Pat. No. 9,580,656.
(Continued)

(51) Int. Cl.
*C10B 31/00* (2006.01)
*C10B 31/06* (2006.01)
(Continued)

(52) U.S. Cl.
CPC ..... *C10B 25/02* (2013.01); *C10B 31/00* (2013.01); *C10B 31/02* (2013.01); *C10B 31/06* (2013.01);
(Continued)

(58) Field of Classification Search
CPC ..... C10B 25/06; C10B 25/08; C10B 25/12; C10B 25/16; C10B 35/00; C10B 31/00;
(Continued)

(56) References Cited

U.S. PATENT DOCUMENTS 425,797 A 4/1890 Hunt
469,868 A 3/1892 Osbourn
(Continued)

FOREIGN PATENT DOCUMENTS

CA 1172895 A 8/1984
CA 2775992 A1 5/2011
(Continued)

OTHER PUBLICATIONS

"Conveyor Chain Designer Guild", Mar. 27, 2014 (date obtained from wayback machine), Renold.com, Section 4, avaiable online at: http://www.renold.com/upload/renoldswitzerland/conveyor_chain_-_designer_guide.pdf.*
(Continued)

*Primary Examiner* — Jonathan Miller
*Assistant Examiner* — Jonathan Luke Pilcher
(74) *Attorney, Agent, or Firm* — Perkins Coie LLP

(57) ABSTRACT

The present technology is generally directed to coal charging systems used with coke ovens. In some embodiments, a coal charging system includes a charging head having opposing wings that extend outwardly from the charging head, leaving an open pathway through which coal may be directed toward side edges of the coal bed. In other embodiments, an extrusion plate is positioned on a rearward face of the charging head and oriented to engage and compress coal as the coal is charged along a length of the coking oven. In other embodiments, charging plates extend outwardly from inward faces of opposing wings.

10 Claims, 25 Drawing Sheets

Related U.S. Application Data

(60) Provisional application No. 62/043,359, filed on Aug. 28, 2014.

(51) Int. Cl.

| | |
|---|---|
| ***C10B 31/08*** | (2006.01) |
| ***C10B 31/10*** | (2006.01) |
| ***C10B 25/02*** | (2006.01) |
| ***C10B 31/02*** | (2006.01) |
| ***C10B 37/04*** | (2006.01) |
| ***C10B 39/06*** | (2006.01) |
| ***C10B 57/08*** | (2006.01) |
| ***C10B 57/02*** | (2006.01) |
| ***C10B 37/02*** | (2006.01) |
| *C10B 15/00* | (2006.01) |
| *C10B 15/02* | (2006.01) |
| *C10B 5/00* | (2006.01) |

(52) U.S. Cl.

CPC ..... *C10B 31/08* (2013.01); *C10B 31/10* (2013.01); *C10B 37/02* (2013.01); *C10B 37/04* (2013.01); *C10B 39/06* (2013.01); *C10B 57/02* (2013.01); *C10B 57/08* (2013.01); *C10B 5/00* (2013.01); *C10B 15/00* (2013.01); *C10B 15/02* (2013.01)

(58) Field of Classification Search

CPC ..... C10B 31/02; C10B 31/04; C10B 31/06; C10B 31/08; C10B 31/10; C10B 5/00; C10B 5/02; C10B 5/04; C10B 5/06; C10B 5/08; C10B 15/00; C10B 15/02; C10B 33/00; C10B 33/08; C10B 33/10; C10B 37/00; C10B 37/02; C10B 37/04; C10B 37/06; C10B 5/10; C10B 5/12; C10B 5/14; C10B 5/16; C10B 5/18; C10B 5/20; C10B 25/24

See application file for complete search history.

(56) References Cited

U.S. PATENT DOCUMENTS 845,719 A * 2/1907 Schniewind ..... C10B 31/08 110/110
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,572,391 A 2/1926 Kiaiber
1,677,973 A 7/1928 Marquard
1,721,813 A 7/1929 Geipert
1,818,370 A 8/1931 Wine
1,818,994 A 8/1931 Kreisinger
1,848,818 A 3/1932 Becker
1,955,962 A 4/1934 Jones
2,075,337 A 3/1937 Burnaugh
2,394,173 A 2/1946 Harris et al.
2,424,012 A 7/1947 Bangham et al.
2,649,978 A * 8/1953 Such ..... B65G 69/0408 414/180
2,667,185 A 1/1954 Beavers
2,723,725 A 11/1955 Keifer
2,756,842 A 7/1956 Chamberlin et al.
2,873,816 A 2/1959 Umbricht et al.
2,902,991 A 9/1959 Whitman
3,015,893 A 1/1962 McCreary
3,033,764 A 5/1962 Hannes
3,462,345 A 8/1969 Kernan
3,511,030 A 5/1970 Hall et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,984,289 A 10/1976 Sustarsic et al.
4,004,702 A 1/1977 Szendroi
4,004,983 A 1/1977 Pries
4,040,910 A 8/1977 Knappstein et al.
4,045,299 A 8/1977 MacDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Ciarimboli
4,124,450 A 11/1978 MacDonald
4,141,796 A 2/1979 Clark et al.
4,145,195 A 3/1979 Knappstein et al.
4,147,230 A 4/1979 Ormond et al.
4,162,546 A 7/1979 Shorten
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,296,938 A 10/1981 Offermann et al.
4,302,935 A 12/1981 Cousimano
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.

(56) References Cited

U.S. PATENT DOCUMENTS 4,342,195 A 8/1982 Lo
4,344,820 A 8/1982 Thompson
4,344,822 A 8/1982 Schwartz et al.
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,527,488 A 7/1985 Lindgren
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,704,195 A 11/1987 Janicka et al.
4,720,262 A 1/1988 Durr et al.
4,726,465 A 2/1988 Kwasnik et al.
4,793,981 A 12/1988 Doyle et al.
4,824,614 A 4/1989 Jones
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,318,671 A 6/1994 Pruitt
5,423,152 A 6/1995 Kolvek
5,447,606 A 9/1995 Pruitt
5,480,594 A 1/1996 Wilkerson et al.
5,622,280 A 4/1997 Mays et al.
5,659,110 A 8/1997 Herden et al.
5,670,025 A 9/1997 Baird
5,687,768 A 11/1997 Mull, Jr. et al.
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker et al.
7,056,390 B2 6/2006 Fratello et al.
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,803,627 B2 9/2010 Hodges
7,823,401 B2 11/2010 Takeuchi et al.
7,827,689 B2 11/2010 Crane et al.
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,152,970 B2 4/2012 Barkdoll et al.
8,236,142 B2 8/2012 Westbrook
8,266,853 B2 9/2012 Bloom et al.
8,398,935 B2 3/2013 Howell, Jr. et al.
9,039,869 B2 5/2015 Kim et al.
9,238,778 B2 1/2016 Quanci et al.
9,243,186 B2 1/2016 Quanci et al.
9,249,357 B2 2/2016 Quanci et al.
2002/0170605 A1 11/2002 Shiraishi et al.
2003/0014954 A1 1/2003 Ronning et al.
2003/0015809 A1 1/2003 Carson
2005/0087767 A1 4/2005 Fitzgerald et al.
2006/0102420 A1 5/2006 Huber et al.
2006/0149407 A1 7/2006 Markham et al.
2007/0116619 A1 5/2007 Taylor et al.
2007/0251198 A1 11/2007 Witter
2008/0028935 A1 2/2008 Andersson
2008/0179165 A1 7/2008 Chen et al.
2008/0257236 A1 10/2008 Green
2008/0271985 A1 11/2008 Yamasaki
2008/0289305 A1 11/2008 Girondi
2009/0007785 A1 1/2009 Kimura et al.
2009/0152092 A1 6/2009 Kim et al.
2009/0162269 A1 6/2009 Barger et al.
2009/0217576 A1 9/2009 Kim et al.
2009/0283395 A1 11/2009 Hippe
2010/0095521 A1 4/2010 Bertini et al.
2010/0113266 A1 5/2010 Abe et al.
2010/0115912 A1 5/2010 Worley
2010/0287871 A1 11/2010 Bloom et al.
2010/0300867 A1 12/2010 Kim et al.
2010/0314234 A1 12/2010 Knoch et al.
2011/0048917 A1 3/2011 Kim et al.
2011/0120852 A1 5/2011 Kim
2011/0174301 A1 7/2011 Haydock et al.
2011/0192395 A1 8/2011 Kim
2011/0223088 A1 9/2011 Chang et al.
2011/0253521 A1 10/2011 Kim
2011/0315538 A1 12/2011 Kim et al.
2012/0024688 A1 2/2012 Barkdoll
2012/0030998 A1 2/2012 Barkdoll et al.
2012/0152720 A1 6/2012 Reichelt et al.
2012/0180133 A1 7/2012 Al-Harbi et al.
2012/0228115 A1 9/2012 Westbrook
2012/0247939 A1 10/2012 Kim et al.
2012/0305380 A1 12/2012 Wang et al.
2013/0045149 A1 2/2013 Miller
2013/0216717 A1 8/2013 Rago et al.
2013/0220373 A1 8/2013 Kim
2013/0306462 A1 11/2013 Kim et al.
2014/0033917 A1 2/2014 Rodgers et al.
2014/0039833 A1 2/2014 Sharpe, Jr. et al.
2014/0048402 A1 2/2014 Quanci et al.
2014/0061018 A1 3/2014 Sarpen et al.
2014/0083836 A1 3/2014 Quanci et al.
2014/0182195 A1 7/2014 Quanci et al.

(56) References Cited

U.S. PATENT DOCUMENTS

| | | | |
|---|---|---|---|
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0219530 | A1 | 8/2015 | Li et al. |
| 2015/0247092 | A1 | 9/2015 | Quanci et al. |
| 2015/0287026 | A1 | 10/2015 | Yang et al. |
| 2015/0328576 | A1 | 11/2015 | Quanci et al. |
| 2015/0361346 | A1 | 12/2015 | West et al. |
| 2015/0361347 | A1 | 12/2015 | Ball et al. |
| 2016/0032193 | A1 | 2/2016 | Sarpen et al. |
| 2016/0060532 | A1 | 3/2016 | Quanci et al. |
| 2016/0060533 | A1 | 3/2016 | Quanci et al. |
| 2016/0060534 | A1 | 3/2016 | Quanci et al. |
| 2016/0060536 | A1 | 3/2016 | Quanci et al. |
| 2016/0149944 | A1 | 5/2016 | Obermeier et al. |
| 2016/0152897 | A1 | 6/2016 | Quanci et al. |
| 2016/0160123 | A1 | 6/2016 | Quanci et al. |
| 2016/0186063 | A1 | 6/2016 | Quanci et al. |
| 2016/0186064 | A1 | 6/2016 | Quanci et al. |
| 2016/0186065 | A1 | 6/2016 | Quanci et al. |
| 2016/0222297 | A1 | 8/2016 | Choi et al. |
| 2016/0319197 | A1 | 11/2016 | Quanci et al. |
| 2016/0319198 | A1 | 11/2016 | Quanci et al. |
| 2017/0015908 | A1 | 1/2017 | Quanci et al. |

FOREIGN PATENT DOCUMENTS

| | | | |
|---|---|---|---|
| CA | 2822841 | A1 | 7/2012 |
| CA | 2822857 | A1 | 7/2012 |
| CN | 87212113 | U | 6/1988 |
| CN | 87107195 | A | 7/1988 |
| CN | 2064363 | U | 10/1990 |
| CN | 1092457 | A | 9/1994 |
| CN | 1255528 | A | 6/2000 |
| CN | 1358822 | A | 7/2002 |
| CN | 2509188 | Y | 9/2002 |
| CN | 2521473 | Y | 11/2002 |
| CN | 2528771 | Y | 1/2003 |
| CN | 1468364 | A | 1/2004 |
| CN | 1527872 | A | 9/2004 |
| CN | 2668641 | Y | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 201121178 | Y | 9/2008 |
| CN | 100510004 | C | 7/2009 |
| CN | 101486017 | A | 7/2009 |
| CN | 101497835 | A | 8/2009 |
| CN | 101509427 | A | 8/2009 |
| CN | 102155300 | A | 8/2011 |
| CN | 202226816 | U | 5/2012 |
| CN | 102584294 | A | 7/2012 |
| CN | 103468289 | A | 12/2013 |
| DE | 212176 | C | 7/1909 |
| DE | 1212037 | B | 3/1966 |
| DE | 3315738 | A1 | 11/1983 |
| DE | 3231697 | C1 | 1/1984 |
| DE | 3329367 | C1 | 11/1984 |
| DE | 3328702 | A1 | 2/1985 |
| DE | 19545736 | A1 | 6/1997 |
| DE | 19803455 | C1 | 8/1999 |
| DE | 10122531 | A1 | 11/2002 |
| DE | 10154785 | A1 | 5/2003 |
| DE | 102005015301 | A1 | 10/2006 |
| DE | 102006004669 | A1 | 8/2007 |
| DE | 102006026521 | A1 | 12/2007 |
| DE | 102009031436 | A1 | 1/2011 |
| DE | 102011052785 | B3 | 12/2012 |
| EP | 0208490 | A1 | 1/1987 |
| EP | 2295129 | A1 | 3/2011 |
| FR | 2339664 | A1 | 8/1977 |
| GB | 441784 | A | 1/1936 |
| GB | 606340 | A | 8/1948 |
| GB | 611524 | A | 11/1948 |
| GB | 725865 | A | 3/1955 |
| GB | 871094 | A | 6/1961 |
| JP | S50148405 | | 11/1975 |
| JP | 54054101 | A | 4/1979 |
| JP | S5453103 | A | 4/1979 |
| JP | 57051786 | A | 3/1982 |
| JP | 57051787 | A | 3/1982 |
| JP | 57083585 | A | 5/1982 |
| JP | 57090092 | A | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 60004588 | A | 1/1985 |
| JP | 61106690 | A | 5/1986 |
| JP | 62011794 | A | 1/1987 |
| JP | 62285980 | | 12/1987 |
| JP | 01103694 | A | 4/1989 |
| JP | 01249886 | A | 10/1989 |
| JP | H0319127 | | 3/1991 |
| JP | H04178494 | A | 6/1992 |
| JP | H06264062 | A | 9/1994 |
| JP | 07188668 | | 7/1995 |
| JP | 07216357 | | 8/1995 |
| JP | 08127778 | A | 5/1996 |
| JP | H10273672 | A | 10/1998 |
| JP | H11-131074 | | 5/1999 |
| JP | 2000-204373 | | 7/2000 |
| JP | 2001200258 | A | 7/2001 |
| JP | 03197588 | B2 | 8/2001 |
| JP | 2002106941 | A | 4/2002 |
| JP | 2003041258 | A | 2/2003 |
| JP | 2003071313 | A | 3/2003 |
| JP | 2003292968 | A | 10/2003 |
| JP | 2003342581 | A | 12/2003 |
| JP | 2005263983 | A | 9/2005 |
| JP | 2007063420 | A | 3/2007 |
| JP | 04159392 | B2 | 10/2008 |
| JP | 2008231278 | A | 10/2008 |
| JP | 2009144121 | A | 7/2009 |
| JP | 2012102302 | A | 5/2012 |
| JP | 2013006957 | A | 1/2013 |
| KR | 1019960008754 | | 10/1996 |
| KR | 1019990054426 | | 7/1999 |
| KR | 20000042375 | A | 7/2000 |
| KR | 1020050053861 | A | 6/2005 |
| KR | 100737393 | B1 | 7/2007 |
| KR | 10-0797852 | B1 | 1/2008 |
| KR | 20110010452 | A | 2/2011 |
| KR | 10-0296700 | B1 | 10/2011 |
| KR | 101318388 | B1 | 10/2013 |
| SU | 1535880 | A1 | 1/1990 |
| TW | 201241166 | A | 10/2012 |
| WO | WO-9012074 | A1 | 10/1990 |
| WO | WO-9945083 | A1 | 9/1999 |
| WO | WO-2005023649 | A1 | 3/2005 |
| WO | WO-2005115583 | A1 | 12/2005 |
| WO | WO-2007103649 | A2 | 9/2007 |
| WO | WO-2008034424 | A1 | 3/2008 |
| WO | WO-2010107513 | A1 | 9/2010 |
| WO | WO-2011000447 | A1 | 1/2011 |
| WO | WO-2012029979 | A1 | 3/2012 |
| WO | WO-2013023872 | A1 | 2/2013 |
| WO | WO-2014021909 | A1 | 2/2014 |
| WO | WO2014153050 | | 9/2014 |

OTHER PUBLICATIONS

U.S. Appl. No. 15/322,176, filed Dec. 27, 2016, West et al.
U.S. Appl. No. 15/392,972, filed Dec. 28, 2016, Quanci et al.
U.S. Appl. No. 15/511,036, filed Mar. 14, 2017, West et al.

(56) References Cited

OTHER PUBLICATIONS

"Resources and Utilization of Coking Coal in China," Mingxin Shen ed., Chemical Industry Press, first edition, Jan. 2007, pp. 242-243, 247.
ASTM D5341-99(2010)e1, Standard Test Method for Measuring Coke Reactivity Index (CRI) and Coke Strength After Reaction (CSR), ASTM International, West Conshohocken, PA, 2010.
Basset et al., "Calculation of steady flow pressure loss coefficients for pipe junctions," Proc Instn Mech Engrs., vol. 215, Part C. IMechIE 2001.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Clean coke process: process development studies by USS Engineers and Consultants, Inc., Wisconsin Tech Search, request date Oct. 5, 2011, 17 pages.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
JP 03-197588, Inoue Keizo et al., Method and Equipment for Boring Degassing Hole in Coal Charge in Coke Oven, Japanese Patent (Abstract Only) Aug. 28, 1991.
JP 04-159392, Inoue Keizo et al., Method and Equipment for Opening Hole for Degassing of Coal Charge in Coke Oven, Japanese Patent (Abstract Only) Jun. 2, 1992.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
"Middletown Coke Company HRSG Maintenance BACT Analysis Option 1—Individual Spray Quenches Sun Heat Recovery Coke Facility Process Flow Diagram Middletown Coke Company 100 Oven Case #1—24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11 *.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Westbrook, "Heat-Recovery Cokemaking at Sun Coke," AISE Steel Technology, Pittsburg, PA, vol. 76, No. 1, Jan. 1999, pp. 25-28.
Yu et al., "Coke Oven Production Technology," Lianoning Science and Technology Press, first edition, Apr. 2014, pp. 356-358.
International Search Report and Written Opinion of International Application No. PCT/US2015/047511; dated Oct. 26, 2015; 10 pages.
Australian Examination Report No. 1 for Australian Patent Application No. 2015308674, dated Mar. 9, 2017.
Canadian Office Action in Canadian Application No. 2,959,367, dated Mar. 27, 2017, 4 pages.
U.S. Appl. No. 15/614,525, filed Jun. 5, 2017, Quanci et al.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Korean Office Action for Korean Application No. 10-2017-7005693; dated Jul. 17, 2017; 13 pages.
Chinese Office Action in Chinese Application No. 201580049825.5; dated Jul. 21, 2017.
Japanese Notice of Rejection for Japanese Application No. 2017-511644; dated Aug. 1, 2017, 7 pages.
Bloom, et al., "Modular cast block—The future of coke oven repairs," Iron & Steel Technol, AIST, Warrendale, PA, vol. 4, No. 3, Mar. 1, 2007, pp. 61-64.
Chinese Office Action in Chinese Application No. 201580049825.5; dated Feb. 26, 2018; 8 pages.
Extended European Search Report for European Application No. 15836056.0; dated Feb. 15, 2018; 4 pages.
Japanese Notice of Rejection for Japanese Application No. 2017-511644; dated Feb. 13, 2018, 5 pages.

* cited by examiner

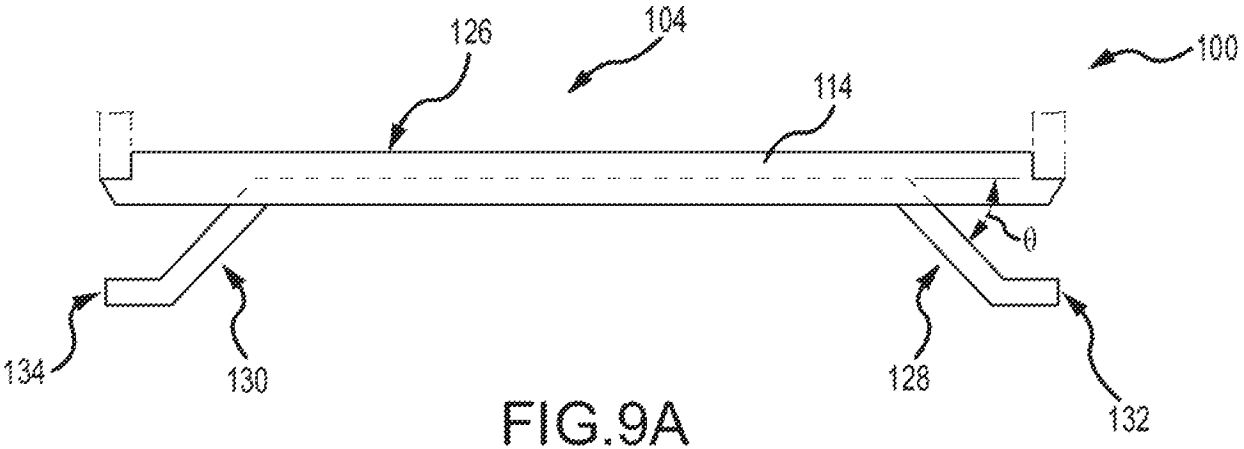
FIG.9A
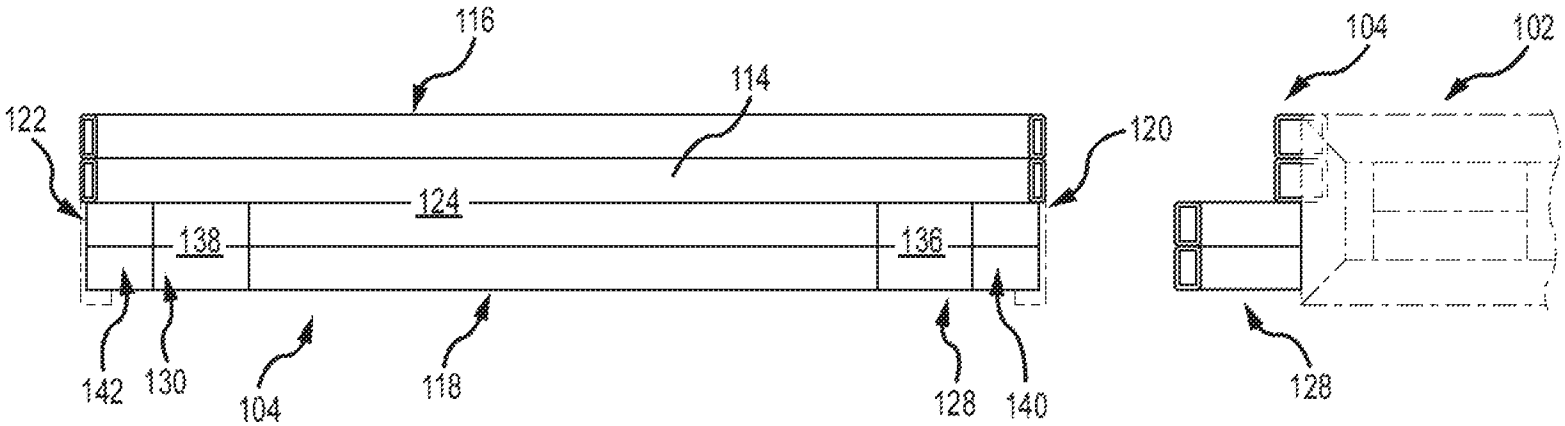
FIG.9B
FIG.9C

COKE OVEN CHARGING SYSTEM

CROSS-REFERENCE TO RELATED APPLICATIONS

This application is a continuation of U.S. patent application Ser. No. 14/839,384, filed Aug. 28, 2015, which claims the benefit of priority to U.S. Provisional Patent Application No. 62/043,359, filed Aug. 28, 2014, the disclosures of which are incorporated herein by reference in their entirety.

TECHNICAL FIELD

The present technology is generally directed to coke oven charging systems and methods of use.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for twenty-four to forty-eight hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

Much of the coke manufacturing process is automated due to the extreme temperatures involved. For example, a pusher charger machine ("PCM") is typically used on the coal side of the oven for a number of different operations. A common PCM operation sequence begins as the PCM is moved along a set of rails that run in front of an oven battery to an assigned oven and align a coal charging system of the PCM with the oven. The pusher side oven door is removed from the oven using a door extractor from the coal charging system. The PCM is then moved to align a pusher ram of the PCM to the center of the oven. The pusher ram is energized, to push coke from the oven interior. The PCM is again moved away from the oven center to align the coal charging system with the oven center. Coal is delivered to the coal charging system of the PCM by a tripper conveyor. The coal charging system then charges the coal into the oven interior. In some systems, particulate matter entrained in hot gas emissions that escape from the oven face are captured by the PCM during the step of charging the coal. In such systems, the particulate matter is drawn into an emissions hood through the baghouse of a dust collector. The charging conveyor is then retracted from the oven. Finally, the door extractor of the PCM replaces and latches the pusher side oven door.

With reference to FIG. 1, PCM coal charging systems 10 have commonly included an elongated frame 12 that is mounted on the PCM (not depicted) and reciprocally movable, toward and away from the coke ovens. A planar charging head 14 is positioned at a free distal end of the elongated frame 12. A conveyor 16 is positioned within the elongated frame 12 and substantially extends along a length of the elongated frame 12. The charging head 14 is used, in a reciprocal motion, to generally level the coal that is deposited in the oven. However, with regard to FIGS. 2A, 3A, and 4A, the prior art coal charging systems tend to leave voids 16 at the sides of the coal bed, as shown in FIG. 2A, and hollow depressions in the surface of the coal bed. These voids limit the amount of coal that can be processed by the coke oven over a coking cycle time (coal processing rate), which generally reduces the amount of coke produced by the coke oven over the coking cycle (coke production rate). FIG. 2B depicts the manner in which an ideally charged, level coke bed would look.

The weight of coal charging system 10, which can include internal water cooling systems, can be 80,000 pounds or more. When charging system 10 is extended inside the oven during a charging operation, the coal charging system 10 deflects downwardly at its free distal end. This shortens the coal charge capacity. FIG. 3A indicates the drop in bed height caused by the deflections of the coal charging system 10. The plot depicted in FIG. 5 shows the coal bed profile along the oven length. The bed height drop, due to coal charging system deflection, is from five inches to eight inches between the pusher side to the coke side, depending upon the charge weight. As depicted, the effect of the deflection is more significant when less coal is charged into the oven. In general, coal charging system deflection can cause a coal volume loss of approximately one to two tons. FIG. 3B depicts the manner in which an ideally charged, level coke bed would look.

Despite the ill effect of coal charging system deflection, caused by its weight and cantilevered position, the coal charging system 10 provides little benefit in the way of coal bed densification. With reference to FIG. 4A, the coal charging system 10 provides minimal improvement to internal coal bed density, forming a first layer d1 and a second, less dense layer d2 at the bottom of the coal bed. Increasing the density of the coal bed can facilitate conductive heat transfer throughout the coal bed which is a component in determining oven cycle time and oven production capacity. FIG. 6 depicts a set of density measurements taken for an oven test using a prior art coal charging system 10. The line with diamond indicators shows the density on the coal bed surface. The line with the square indicators and the line with the triangular indicators show density twelve inches and twenty-four inches below the surface respectively. The data demonstrates that bed density drops more on the coke side. FIG. 4B depicts the manner in which an ideally charged, level coke bed would look, having relatively increased density layers D1 and D2.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified.

FIG. 9A depicts a top plan view of one embodiment of a charging head according to the present technology.

FIG. 9B depicts a front elevation view of the charging head depicted in FIG. 9A.

FIG. 9C depicts a side elevation view of the charging head depicted in FIG. 9A.

DETAILED DESCRIPTION

Figure 1:
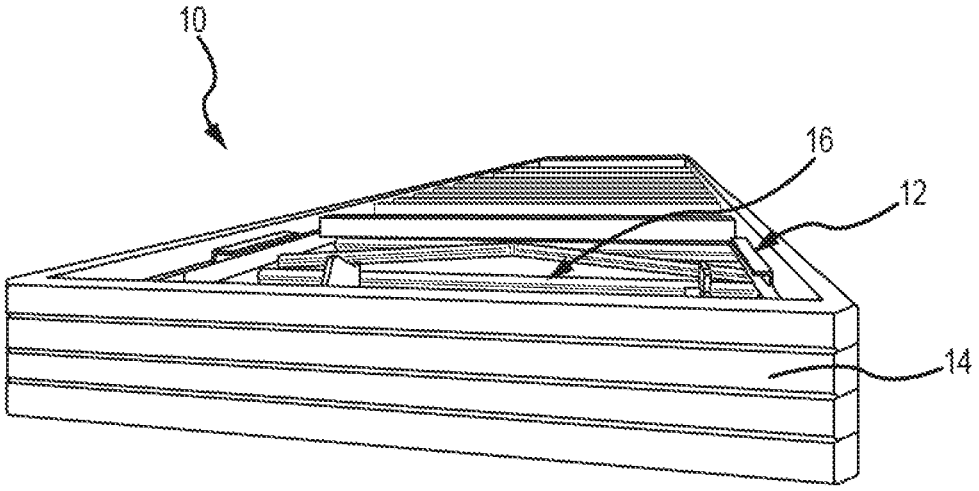
FIG. 1 (PRIOR ART)
FIG. 1 depicts a front perspective view of a prior art coal charging system.

The present technology is generally directed to coal charging systems used with coke ovens. In various embodiments, the coal charging systems, of the present technology, are configured for use with horizontal heat recovery coke ovens. However, embodiments of the present technology can be used with other coke ovens, such as horizontal, non-recovery ovens. In some embodiments, a coal charging system includes a charging head having opposing wings that extend outwardly and forwardly from the charging head, leaving an open pathway through which coal may be directed toward the side edges of the coal bed. In other embodiments, an extrusion plate is positioned on a rearward face of the charging head and oriented to engage and compress coal as the coal is charged along a length of the coking oven. In still other embodiments, a false door is vertically oriented to maximize an amount of coal being charged into the oven.

Specific details of several embodiments of the technology are described below with reference to FIGS. 7-29. Other details describing well-known structures and systems often associated with pusher systems, charging systems, and coke ovens have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 7-29.

It is contemplated that the coal charging technology of the present matter will be used in combination with a pusher charger machine ("PCM") having one or more other components common to PCMs, such as a door extractor, a pusher ram, a tripper conveyor, and the like. However, aspects of the present technology may be used separately from a PCM and may be used individually or with other equipment associated with a coking system. Accordingly, aspects of the present technology may simply be described as "a coal charging system" or components thereof. Components associated with coal charging systems, such as coal conveyers and the like that are well-known may not be described in detail, if at all, to avoid unnecessarily obscuring the description of the various embodiments of the technology.

With reference to FIGS. 7-9C, a coal charging system 100 is depicted, having an elongated charging frame 102 and a charging head 104. In various embodiments, the charging frame 102 will be configured to have opposite sides 106 and 108 that extend between a distal end portion 110 and proximal end portion 112. In various applications, the proximal end portion 112 may be coupled with a PCM in a manner that permits selective extension and retraction of the charging frame 102 into, and from within, a coke oven interior during a coal charging operation. Other systems, such as a height adjustment system that selectively adjusts the height of the charging frame 102 with respect to a coke oven floor and/or a coal bed, may also be associated with the coal charging system 100.

The charging head 104 is coupled with the distal end portion 110 of the elongated charging frame 102. In various embodiments, the charging head 104 is defined by a planar body 114, having an upper edge portion 116, lower edge portion 118, opposite side portions 120 and 122, a front face 124, and a rearward face 126. In some embodiments, a substantial portion of the body 114 resides within a charging head plane. This is not to suggest that embodiments of the present technology will not provide charging head bodies having aspects that occupy one or more additional planes. In various embodiments, the planar body is formed from a plurality of tubes, having square or rectangular cross-sectional shapes. In particular embodiments, the tubes are provided with a width of six inches to twelve inches. In at least one embodiment, the tubes have a width of eight inches, which demonstrated a significant resistance to warping during charging operations.

With further reference to FIGS. 9A-9C, various embodiments of the charging head 104 include a pair of opposing wings 128 and 130 that are shaped to have free end portions 132 and 134. In some embodiments, the free end portions 132 and 134 are positioned in a spaced-apart relationship, forwardly from the charging head plane. In particular embodiments, the free end portions 132 and 134 are spaced forwardly from the charging head plane a distance of six inches to 24 inches, depending on the size of the charging head 104 and the geometry of the opposing wings 128 and 130. In this position, the opposing wings 128 and 130 define open spaces rearwardly from the opposing wings 128 and 130, through the charging head plane. As the design of these open spaces is increased in size, more material is distributed to the sides of the coal bed. As the spaces are made smaller, less material is distributed to the sides of the coal bed. Accordingly, the present technology is adaptable as particular characteristics are presented from coking system to coking system.

Figure 2B:
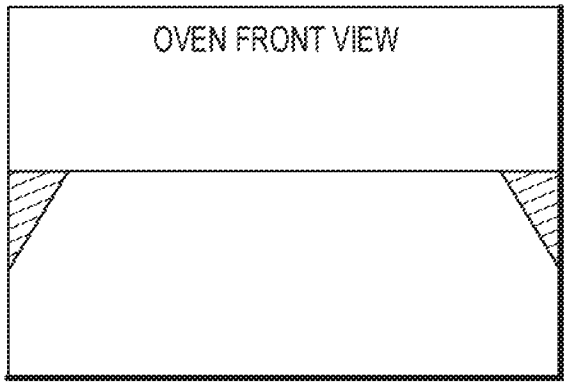
FIG. 2B depicts a front view of a coal bed that was ideally charged into a coke oven, without voids at the sides of the bed.
Figure 2A:
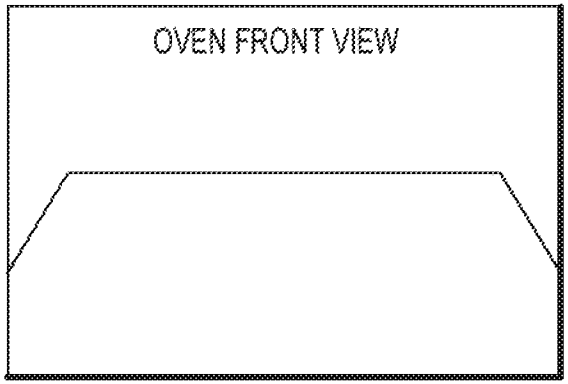
FIG. 2A depicts a front view of a coal bed that was charged into a coke oven using a prior art coal charging system and depicts that the coal bed is not level, having voids at the sides of the bed.
Figure 3B:
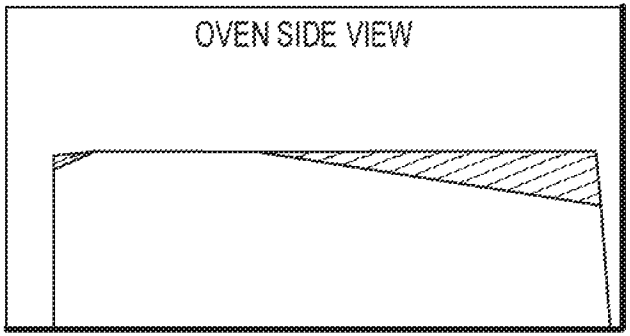
FIG. 3B depicts a side elevation view of a coal bed that was ideally charged into a coke oven, without voids at the end portions of the bed.
Figure 3A:
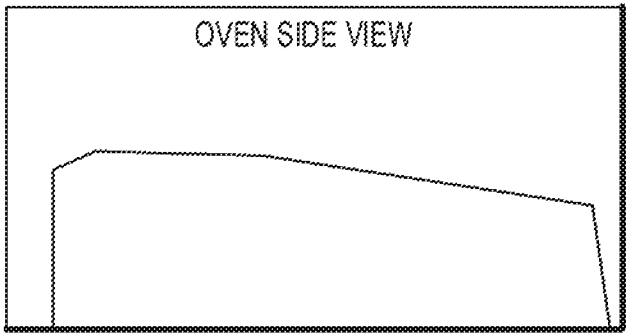
FIG. 3A depicts a side elevation view of a coal bed that was charged into a coke oven using a prior art coal charging system and depicts that the coal bed is not level, having voids at the end portions of the bed.
Figure 4B:
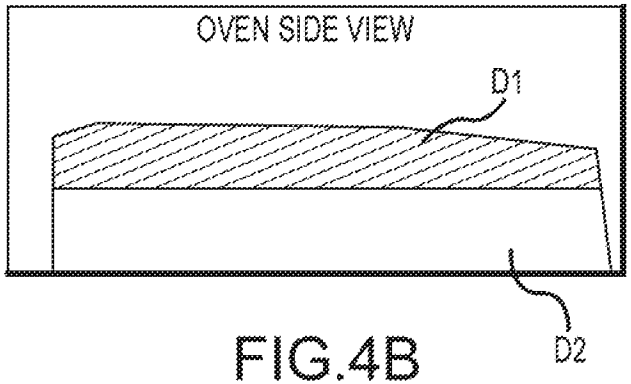
FIG. 4B depicts a side elevation view of a coal bed that was ideally charged into a coke oven having two different layers of relatively increased coal density.
Figure 4A:
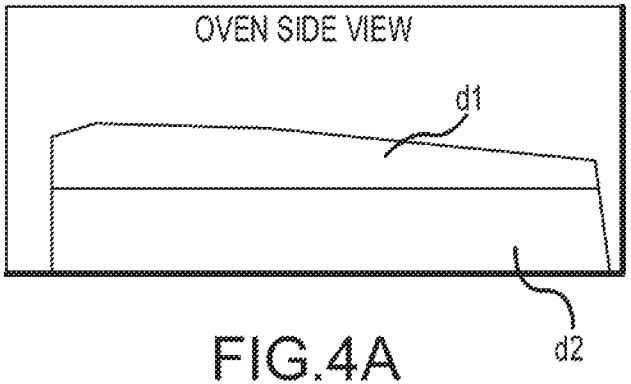
FIG. 4A depicts a side elevation view of a coal bed that was charged into a coke oven using a prior art coal charging system and depicts two different layers of minimal coal density formed by the prior art coal charging system.

In some embodiments, such as depicted in FIGS. 9A-9C, the opposing wings 128 and 130 include first faces 136 and 138 that extend outwardly from the charging head plane. In particular embodiments, the first faces 136 and 138 extend outwardly from the charging plane at a forty-five degree angle. The angle at which the first face deviates from the charging head plane may be increased or decreased according to the particular intended use of the coal charging system 100. For example, particular embodiments may employ an angle of ten degrees to sixty degrees, depending on the conditions anticipated during charging and leveling operations. In some embodiments, the opposing wings 128 and 130 further include second faces 140 and 142 that extend outwardly from the first faces 136 and 138 toward the free distal end portions 132 and 134. In particular embodiments, the second faces 140 and 142 of the opposing wings 128 and 130 reside within a wing plane that is parallel to the charging head plane. In some embodiments, the second faces 140 and 142 are provided to be approximately ten inches in length. In other embodiments, however, the second faces 140 and 142 may have lengths ranging from zero to ten inches, depending on one or more design considerations, including the length selected for the first faces 136 and 138 and the angles at which the first faces 136 and 138 extend away from the charging plane. As depicted in FIGS. 9A-9C, the opposing wings 128 and 130 are shaped to receive loose coal from the rearward face of the charging head 104, while the coal charging system 100 is being withdrawn across the coal bed being charged, and funnel or otherwise direct loose coal toward the side edges of the coal bed. In at least this manner, the coal charging system 100 may reduce the likelihood of voids at the sides of the coal bed, as shown in FIG. 2A. Rather, the wings 128 and 130 help to promote the level coal bed depicted in FIG. 2B. Testing has shown that use of the opposing wings 128 and 130 can increase the charge weight by one to two tons by filling these side voids. Moreover, the shape of the wings 128 and 130 reduce drag back of the coal and spillage from the pusher side of the oven, which reduces waste and the expenditure of labor to retrieve the spilled coal.

Figure 10A:
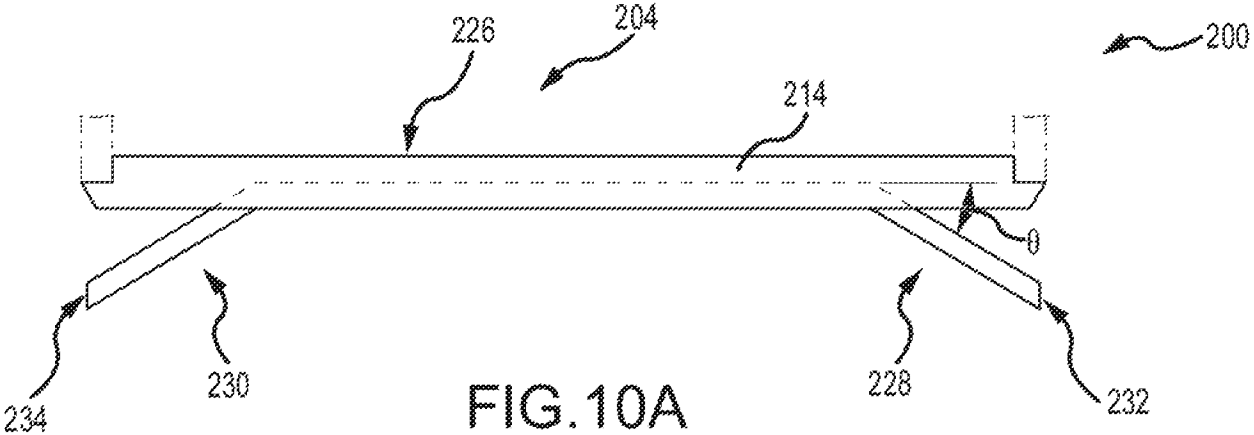
FIG. 10A depicts a top plan view of another embodiment of a charging head according to the present technology.
Figure 10B:
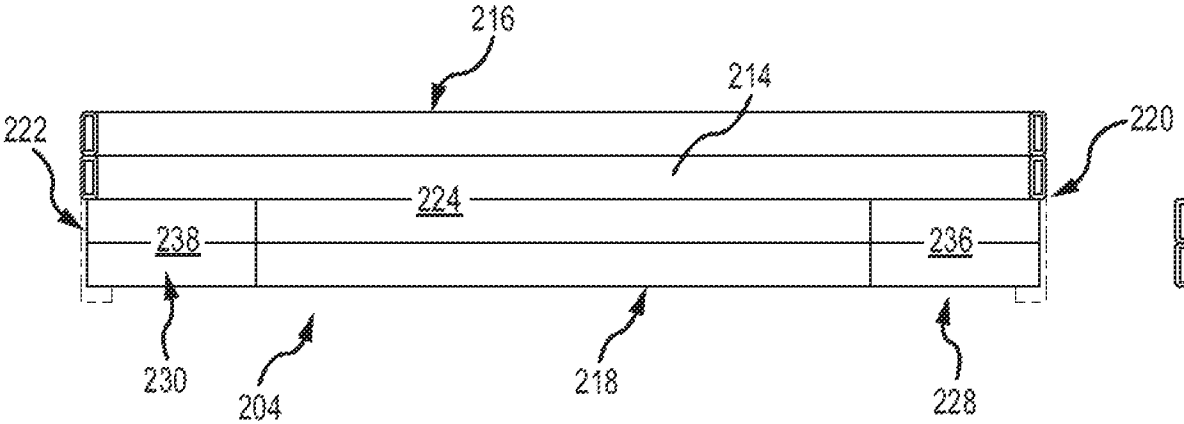
FIG. 10B depicts a front elevation view of the charging head depicted in FIG. 10A.
Figure 10C:
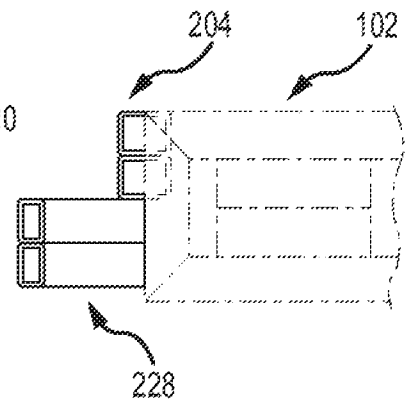
FIG. 10C depicts a side elevation view of the charging head depicted in FIG. 10A.

With reference to FIGS. 10A-10C, another embodiment of a charging head 204 is depicted as having a planar body 214, having an upper edge portion 216, lower edge portion 218, opposite side portions 220 and 222, a front face 224, and a rearward face 226. The charging head 204 further includes a pair of opposing wings 228 and 230 that are shaped to have free end portions 232 and 234 that are positioned in a spaced-apart relationship, forwardly from the charging head plane. In particular embodiments, the free end portions 232 and 234 are spaced forwardly from the charging head plane a distance of six inches to 24 inches. The opposing wings 228 and 230 define open spaces rearwardly from the opposing wings 228 and 230, through the charging head plane. In some embodiments, the opposing wings 228 and 230 include first faces 236 and 238 that extend outwardly from the charging head plane at a forty-five degree angle. In particular embodiments, the angle at which the first faces 236 and 238 deviate from the charging head plane is from ten degrees to sixty degrees, depending on the conditions anticipated during charging and leveling operations. The opposing wings 228 and 230 are shaped to receive loose coal from the rearward face of the charging head 204, while the coal charging system is being withdrawn across the coal bed being charged, and funnel or otherwise direct loose coal toward the side edges of the coal bed.

Figure 11A:
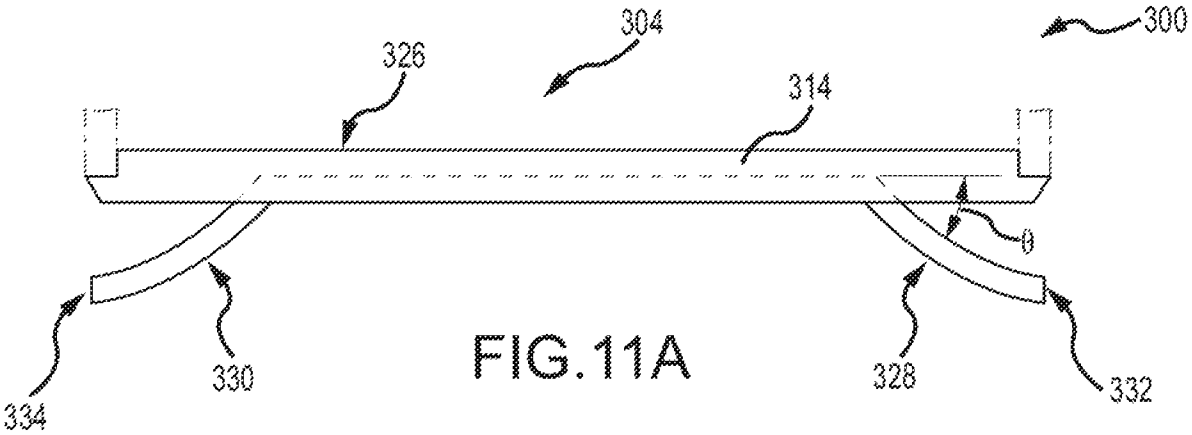
FIG. 11A depicts a top plan view of yet another embodiment of a charging head according to the present technology.
Figure 11B:
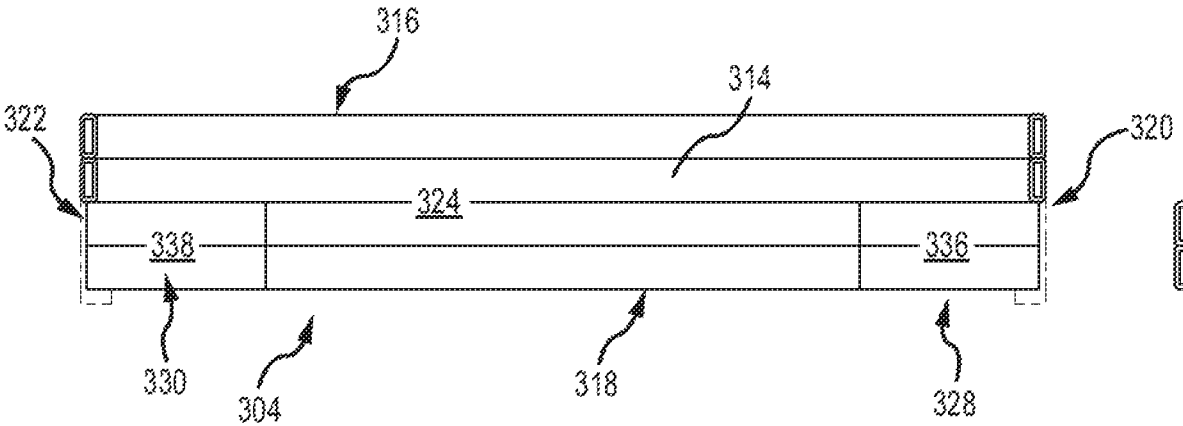
FIG. 11B depicts a front elevation view of the charging head depicted in FIG. 11A.
Figure 11C:
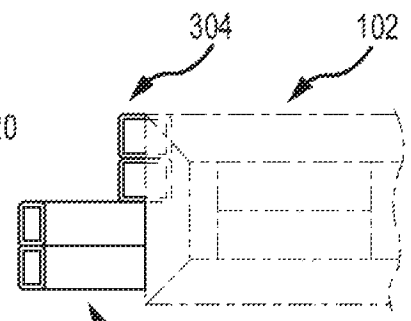
FIG. 11C depicts a side elevation view of the charging head depicted in FIG. 11A.

With reference to FIGS. 11A-11C, a further embodiment of a charging head 304 is depicted as having a planar body 314, having an upper edge portion 316, lower edge portion 318, opposite side portions 320 and 322, a front face 324, and a rearward face 326. The charging head 300 further includes a pair of curved opposing wings 328 and 330 that have free end portions 332 and 334 that are positioned in a spaced-apart relationship, forwardly from the charging head plane. In particular embodiments, the free end portions 332 and 334 are spaced forwardly from the charging head plane a distance of six inches to twenty-four inches. The curved opposing wings 328 and 330 define open spaces rearwardly from the curved opposing wings 328 and 330, through the charging head plane. In some embodiments, the curved opposing wings 328 and 330 include first faces 336 and 338 that extend outwardly from the charging head plane at a forty-five degree angle from a proximal end portion of the curved opposing wings 328 and 330. In particular embodiments, the angle at which the first faces 336 and 338 deviate from the charging head plane is from ten degrees to sixty degrees. This angle dynamically changes along lengths of the curved opposing wings 328 and 330. The opposing wings 328 and 330 receive loose coal from the rearward face of the charging head 304, while the coal charging system is being withdrawn across the coal bed being charged, and funnel or otherwise direct loose coal toward the side edges of the coal bed.

Figure 12A:
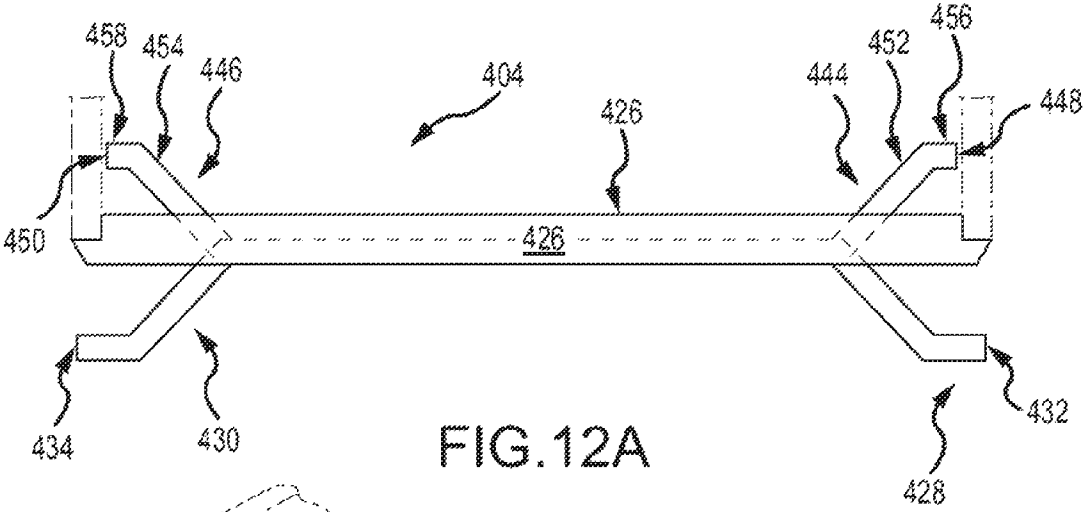
FIG. 12A depicts a top plan view of still another embodiment of a charging head according to the present technology.
Figure 12B:
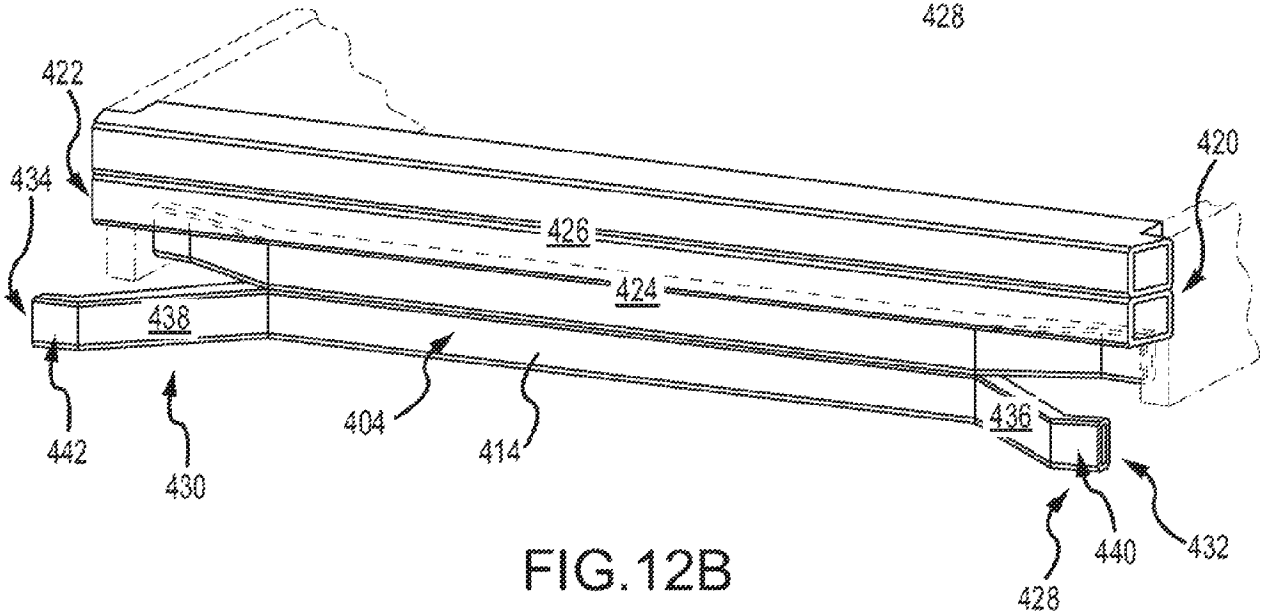
FIG. 12B depicts a front elevation view of the charging head depicted in FIG. 12A.
Figure 12C:
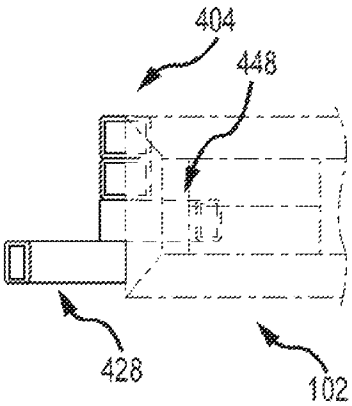
FIG. 12C depicts a side elevation view of the charging head depicted in FIG. 12A.

With reference to FIGS. 12A-12C, an embodiment of a charging head 404 includes a planar body 414, having an upper edge portion 416, lower edge portion 418, opposite side portions 420 and 422, a front face 424, and a rearward face 426. The charging head 400 further includes a first pair of opposing wings 428 and 430 that have free end portions 432 and 434 that are positioned in a spaced-apart relationship, forwardly from the charging head plane. The opposing wings 428 and 430 include first faces 436 and 438 that extend outwardly from the charging head plane. In some embodiments, the first faces 436 and 438 extend outwardly from the charging head plane at a forty-five degree angle. The angle at which the first face deviates from the charging head plane may be increased or decreased according to the particular intended use of the coal charging system 400. For example, particular embodiments may employ an angle of ten degrees to sixty degrees, depending on the conditions anticipated during charging and leveling operations. In some embodiments, the free end portions 432 and 434 are spaced forwardly from the charging head plane a distance of six inches to twenty-four inches. The opposing wings 428 and 430 define open spaces rearwardly from the curved opposing wings 428 and 430, through the charging head plane. In some embodiments, the opposing wings 428 and 430 further include second faces 440 and 442 that extend outwardly from the first faces 436 and 438 toward the free distal end portions 432 and 434. In particular embodiments, the second faces 440 and 442 of the opposing wings 428 and 430 reside within a wing plane that is parallel to the charging head plane. In some embodiments, the second faces 440 and 442 are provided to be approximately ten inches in length. In other embodiments, however, the second faces 440 and 442 may have lengths ranging from zero to ten inches, depending on one or more design considerations, including the length selected for the first faces 436 and 438 and the angles at which the first faces 436 and 438 extend away from the charging plane. The opposing wings 428 and 430 are shaped to receive loose coal from the rearward face of the charging head 404, while the coal charging system 400 is being withdrawn across the coal bed being charged, and funnel or otherwise direct loose coal toward the side edges of the coal bed.

In various embodiments, it is contemplated that opposing wings of various geometries may extend rearwardly from a charging head associated with a coal charging system according to the present technology. With continued reference to FIGS. 12A-12C, the charging head 400 further includes a second pair of opposing wings 444 and 446 that each include free end portions 448 and 450 that are positioned in a spaced-apart relationship, rearwardly from the charging head plane. The opposing wings 444 and 446 include first faces 452 and 454 that extend outwardly from the charging head plane. In some embodiments, the first faces 452 and 454 extend outwardly from the charging head plane at a forty-five degree angle. The angle at which the first faces 452 and 454 deviate from the charging head plane may be increased or decreased according to the particular intended use of the coal charging system 400. For example, particular embodiments may employ an angle of ten degrees to sixty degrees, depending on the conditions anticipated during charging and leveling operations. In some embodiments, the free end portions 448 and 450 are spaced rearwardly from the charging head plane a distance of six inches to twenty-four inches. The opposing wings 444 and 446 define open spaces rearwardly from the opposing wings 444 and 446, through the charging head plane. In some embodiments, the opposing wings 444 and 446 further include second faces 456 and 458 that extend outwardly from the first faces 452 and 454 toward the free distal end portions 448 and 450. In particular embodiments, the second faces 456 and 458 of the opposing wings 444 and 446 reside within a wing plane that is parallel to the charging head plane. In some embodiments, the second faces 456 and 458 are provided to be approximately ten inches in length. In other embodiments, however, the second faces 456 and 458 may have lengths ranging from zero to ten inches, depending on one or more design considerations, including the length selected for the first faces 452 and 454 and the angles at which the first faces 452 and 454 extend away from the charging plane. The opposing wings 444 and 446 are shaped to receive loose coal from the front face 424 of the charging head 404, while the coal charging system 400 is being extended along the coal bed being charged, and funnel or otherwise direct loose coal toward the side edges of the coal bed.

With continued reference to FIGS. 12A-12C, the rearwardly faced opposing wings 444 and 446 are depicted as being positioned above the forwardly faced opposing wings 428 and 430. However, it is contemplated that this particular arrangement may be reversed, in some embodiments, without departing from the scope of the present technology. Similarly, the rearwardly faced opposing wings 444 and 446 and forwardly faced opposing wings 428 and 430 are each depicted as angularly disposed wings having first and second sets of faces that are disposed at angles with respect to one another. However, it is contemplated that either or both sets of opposing wings may be provided in different geometries, such as demonstrated by the straight, angularly disposed opposing wings 228 and 230, or the curved wings 328 and 330. Other combinations of known shapes, intermixed or in pairs, are contemplated. Moreover, it is further contemplated that the charging heads of the present technology could be provided with one or more sets of opposing wings that only face rearwardly from the charging head, with no wings that face forwardly. In such instances, the rearwardly positioned opposing wings will distribute the coal to the side portions of the coal bed when the coal charging system is moving forward (charging).

Figure 13:
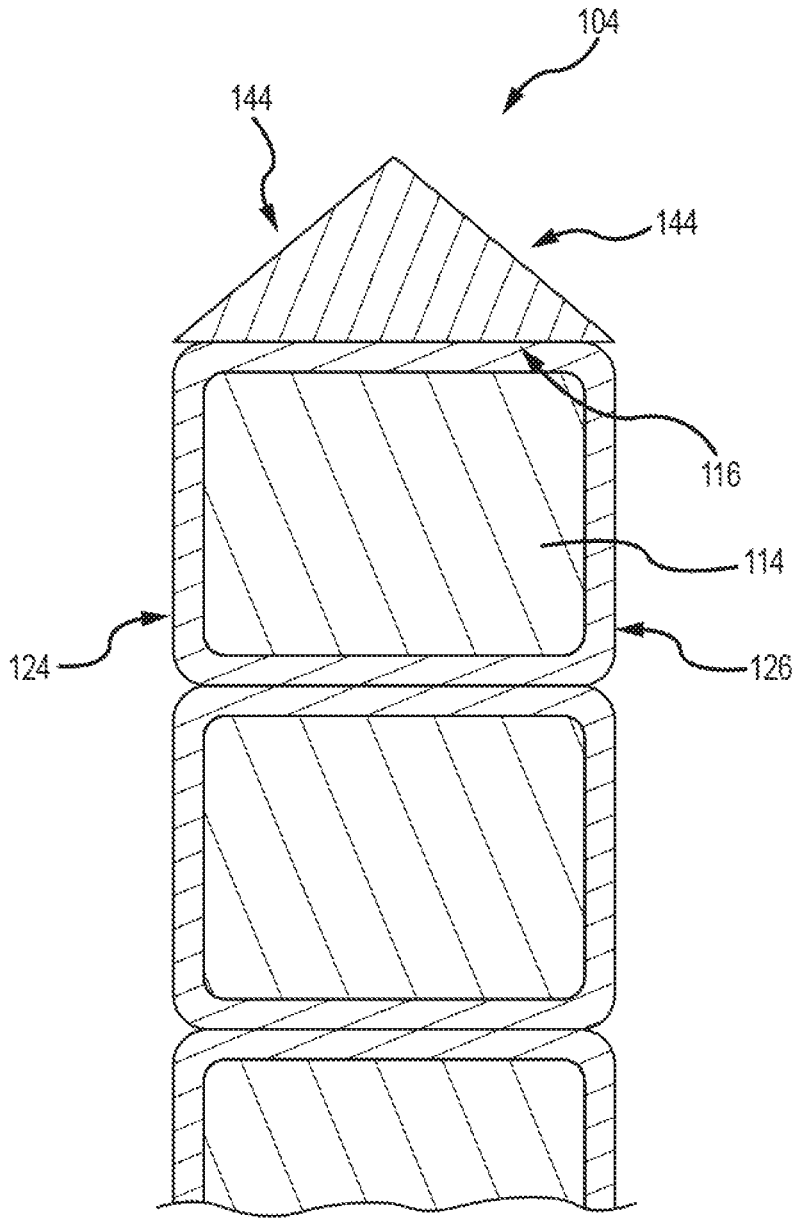
FIG. 13 depicts a side elevation view of one embodiment of a charging head, according to the present technology, wherein the charging head includes particulate deflection surfaces on top of the upper edge portion of the charging head.

With reference to FIG. 13, it is contemplated that, as the coal is being charged into the oven and as the coal charging system 100 (or in a similar manner charging heads 200, 300, or 400) is being withdrawn across the coal bed, loose coal may begin to pile onto the upper edge portion 116 of the charging head 104. Accordingly, some embodiments of the present technology will include one or more angularly disposed particulate deflection surfaces 144 on top of the upper edge portion 116 of the charging head 104. In the depicted example, a pair of oppositely faced particulate deflection surfaces 144 combine to form a peaked structure, which disperses errant particulate material in front of and behind the charging head 104. It is contemplated that it may be desirable in particular instances to have the particulate material land primarily in front of or behind the charging head 104, but not both. Accordingly, in such instances, a single particulate deflection surface 144 may be provided with an orientation chosen to disperse the coal accordingly. It is further contemplated that the particulate deflection surfaces 144 may be provided in other, non-planar or non-angular configurations. In particular, the particulate deflection surfaces 144 may be flat, curvilinear, convex, concave, compound, or various combinations thereof. Some embodiments will merely dispose the particulate deflection surfaces 144 so that they are not horizontally disposed. In some embodiments, the particulate surfaces can be integrally formed with the upper edge portion 116 of the charging head 104, which may further include a water cooling feature.

Figure 14:
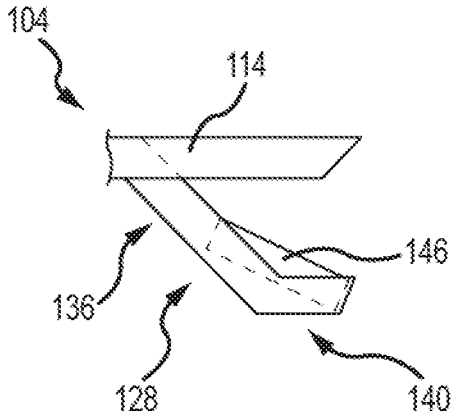
FIG. 14 depicts a partial, top elevation view of one embodiment of the charging head of the present technology and further depicts one embodiment of a densification bar and one manner in which it can be coupled with a wing of the charging head.
Figure 15:
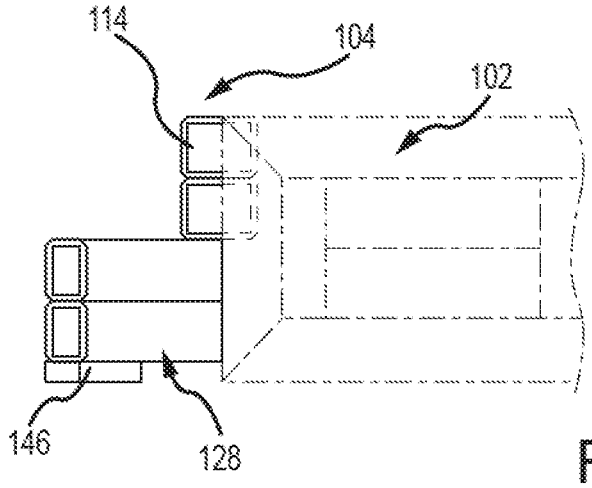
FIG. 15 depicts a side elevation view of the charging head and densification bar depicted in FIG. 14.
Figure 16:
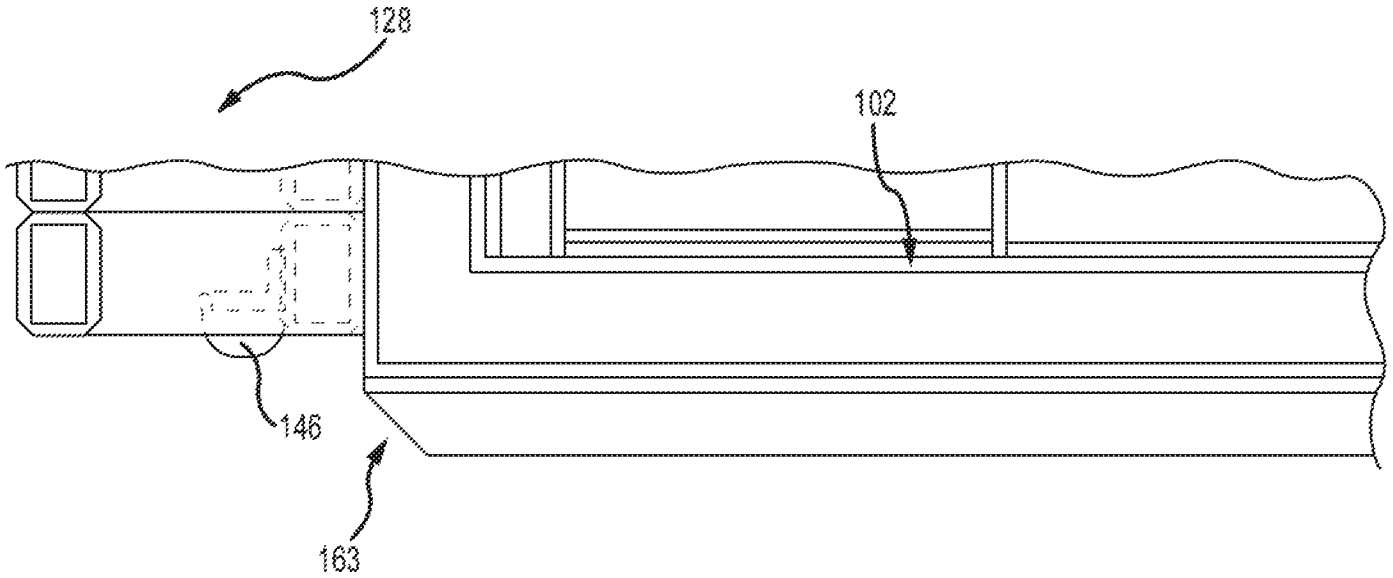
FIG. 16 depicts a partial side elevation view of one embodiment of the charging head of the present technology and further depicts another embodiment of a densification bar and a manner in which it can be coupled with the charging head.

Coal bed bulk density plays a significant role in determining coke quality and minimizing burn loss, particularly near the oven walls. During a coal charging operation, the charging head 104 retracts against a top portion of the coal bed. In this manner, the charging head contributes to the top shape of the coal bed. However, particular aspects of the present technology cause portions of the charging head to increase the density of the coal bed. With regard to FIGS. 14 and 15, the opposing wings 128 and 130 may be provided with one or more elongated densification bars 146 that, in some embodiments, extend along a length of, and downwardly from, each of the opposing wings 128 and 130. In some embodiments, such as depicted in FIGS. 14 and 15, the densification bars 146 may extend downwardly from bottom surfaces of the opposing wings 128 and 130. In other embodiments, such as depicted in FIG. 16, the densification bars 146 may be operatively coupled with forward or rearward faces of either or both of the opposing wings 128 and 130 and/or the lower edge portion 118 of the charging head 104. In particular embodiments, such as depicted in FIG. 14, the elongated densification bar 146 has a long axis disposed at an angle with respect to the charging head plane. It is contemplated that the densification bar 146 may be formed from a roller that rotates about a generally horizontal axis, or a statically mounted structure of various shapes, such as a pipe or rod, formed from a high temperature material. The exterior shape of the elongated densification bar 146 may be planar or curvilinear. Moreover, the elongated densification bar may be curved along its length or angularly disposed.

Figure 17:
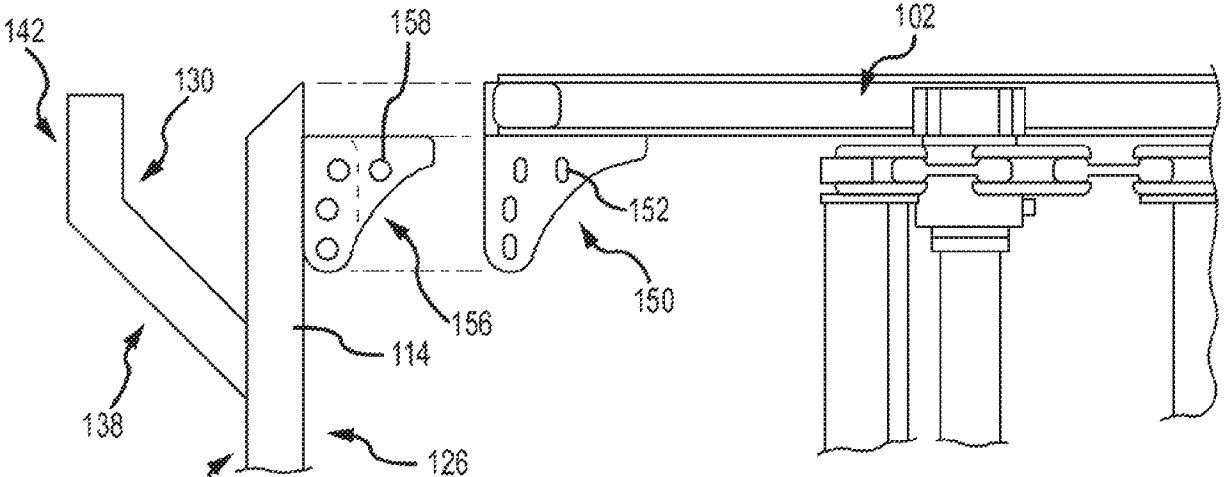
FIG. 17 depicts a partial, top elevation view of one embodiment of a charging head and charging frame, according to the present technology, and further depicts one embodiment of a slotted joint that couples the charging head and charging frame with one another.
Figure 18:
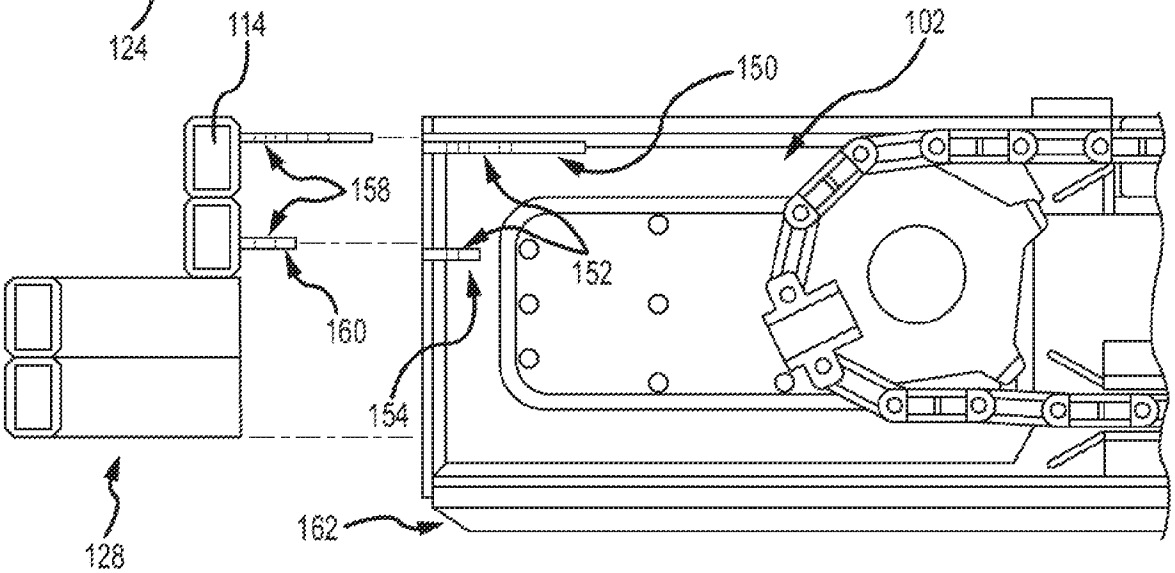
FIG. 18 depicts a partial, cutaway side elevation view of the charging head and charging frame depicted in FIG. 17.

In some embodiments, the charging heads and charging frames of various systems may not include a cooling system. The extreme temperatures of the ovens will cause portions of such charging heads and charging frames to expand slightly, and at different rates, with respect to one another. In such embodiments, the rapid, uneven heating and expansion of the components may stress the coal charging system and warp or otherwise misalign the charging head with respect to the charging frame. With reference to FIGS. 17 and 18, embodiments of the present technology couple the charging head 104 to the sides 106 and 108 of the charging frame 102 using a plurality of slotted joints that allow relative movement between the charging head 104 and the elongated charging frame 102. In at least one embodiment, first frame plates 150 extend outwardly from inner faces of the sides 106 and 108 of the elongated frame 102. The first frame plates 150 include one or more elongated mounting slots 152 that penetrate the first frame plates 150. In some embodiments, second frame plates 154 are also provided to extend outwardly from the inner faces of the sides 106 and 108, beneath the first frame plates 150. The second frame plates 154 of the elongated frame 102 also include one or more elongated mounting slots 152 that penetrate the second frame plates 154. First head plates 156 extend outwardly from opposite sides of the rearward face 126 of the charging head 104. The first head plates 156 include one or more mounting apertures 158 that penetrate the first head plates 156. In some embodiments, second head plates 160 are also provided to extend outwardly from the rearward face 126 of the charging head 104, beneath the first head plates 156. The second head plates 160 also include one or more mounting apertures 158 that penetrate the second head plates 158. The charging head 104 is aligned with the charging frame 102 so that the first frame plates 150 align with first head pates 156 and the second frame plates 154 align with the second head plates 160. Mechanical fasteners 161 pass through the elongated mounting slots 152 of the first frame plates 150 and second frame plates 152 and corresponding mounting apertures 160. In this manner, the mechanical fasteners 161 are placed in a fixed position with respect to the mounting apertures 160 but are allowed to move along lengths of the elongated mounting slots 152 as the charging head 104 move with respect to the charging frame 102. Depending on the size and configuration of the charging head 104 and the elongated charging frame 102, it is contemplated that more or fewer charging head plates and frame plates of various shapes and sizes could be employed to operatively couple the charging head 104 and the elongated charging frame 102 with one another.

Figure 20:
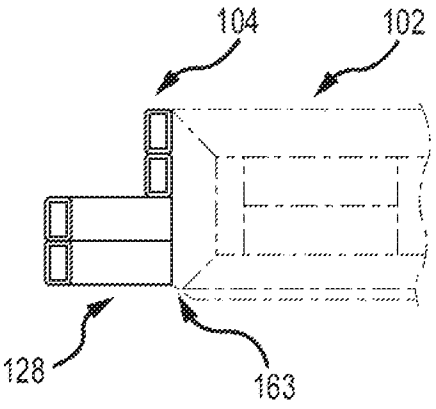
FIG. 20 depicts a partial, cutaway side elevation view of the charging head and charging frame depicted in FIG. 19.
Figure 19:
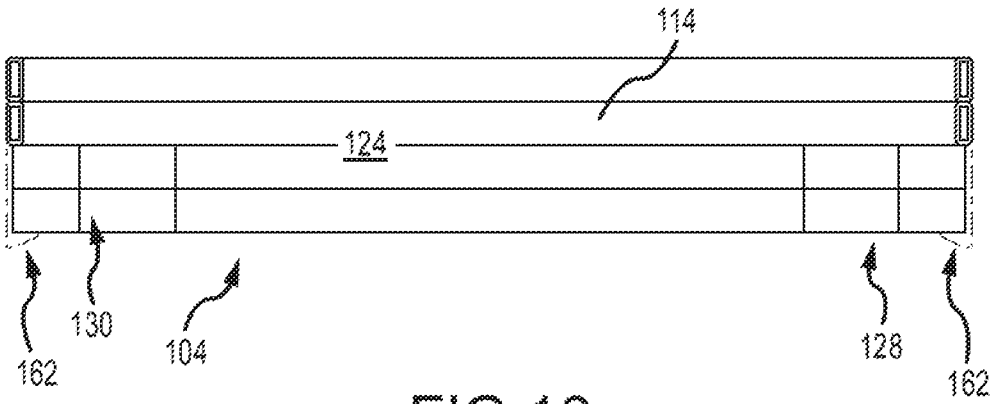
FIG. 19 depicts a partial front elevation view of one embodiment of a charging head and charging frame, according to the present technology, and further depicts one embodiment of a charging frame deflection face that may be associated with the charging frame.
Figure 21:
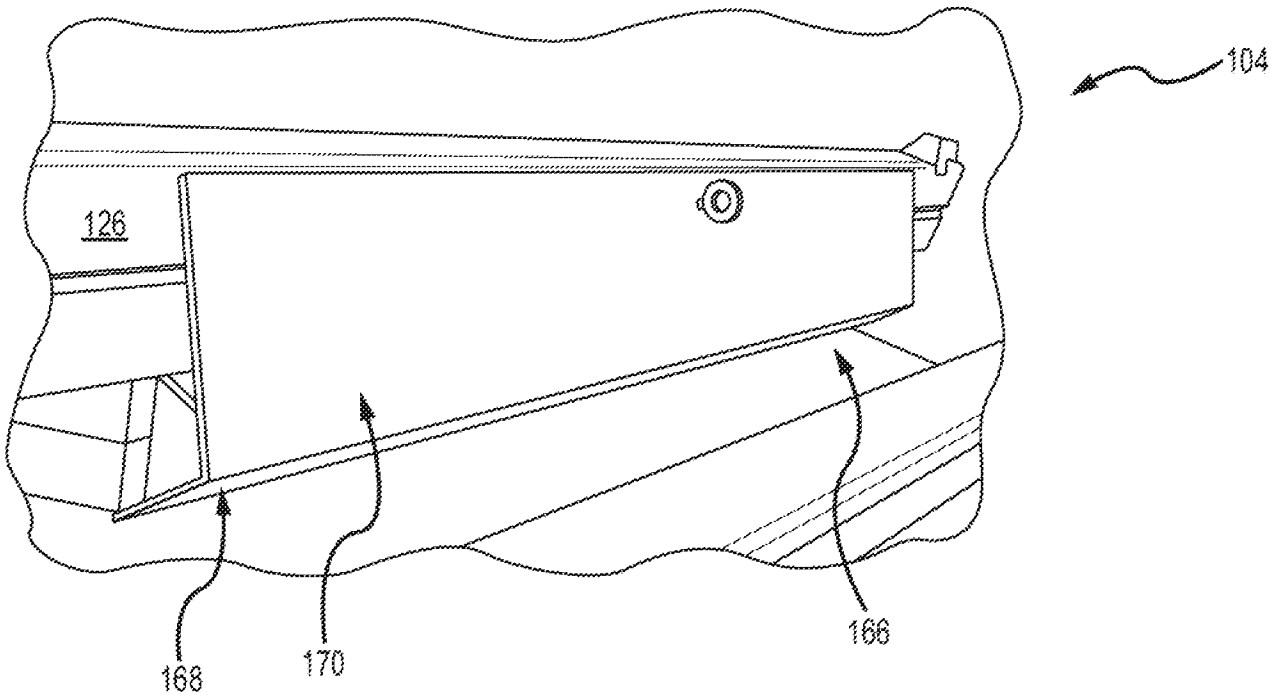
FIG. 21 depicts a front perspective view of one embodiment of an extrusion plate, according to the present technology, and further depicts one manner in which it may be associated with a rearward face of a charging head.
Figure 22:
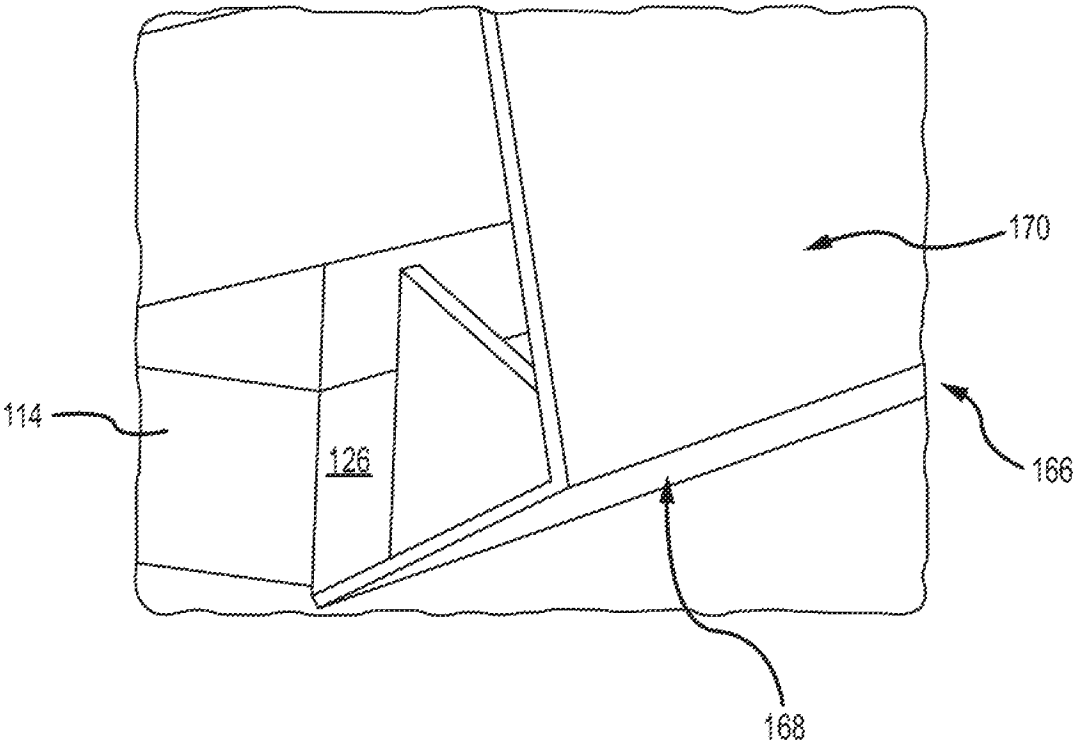
FIG. 22 depicts a partial isometric view of the extrusion plate and charging head depicted in FIG. 21.

With reference to FIGS. 19 and 20, particular embodiments of the present technology provide the lower inner faces of each of the opposite sides 106 and 108 of the elongated charging frame 102 with charging frame deflection faces 162, positioned to face at a slightly downward angle toward a middle portion of the charging frame 102. In this manner, the charging frame deflection faces 162 engage the loosely charged coal and direct the coal down and toward the sides of the coal bed being charged. The angle of the deflection faces 162 further compress the coal downwardly in a manner that helps to increase the density of the edge portions of the coal bed. In another embodiment, forward end portions of each of the opposite sides 106 and 108 of the elongated charging frame 102 include charging frame deflection faces 163 that are also positioned rearwardly from the wings but are oriented to face forwardly and downwardly from the charging frame. In this manner, the deflection faces 163 may further help to increase the density of the coal bed and direct the coal outwardly toward the edge portions of the coal bed in an effort to more fully level the coal bed.

Figure 6:
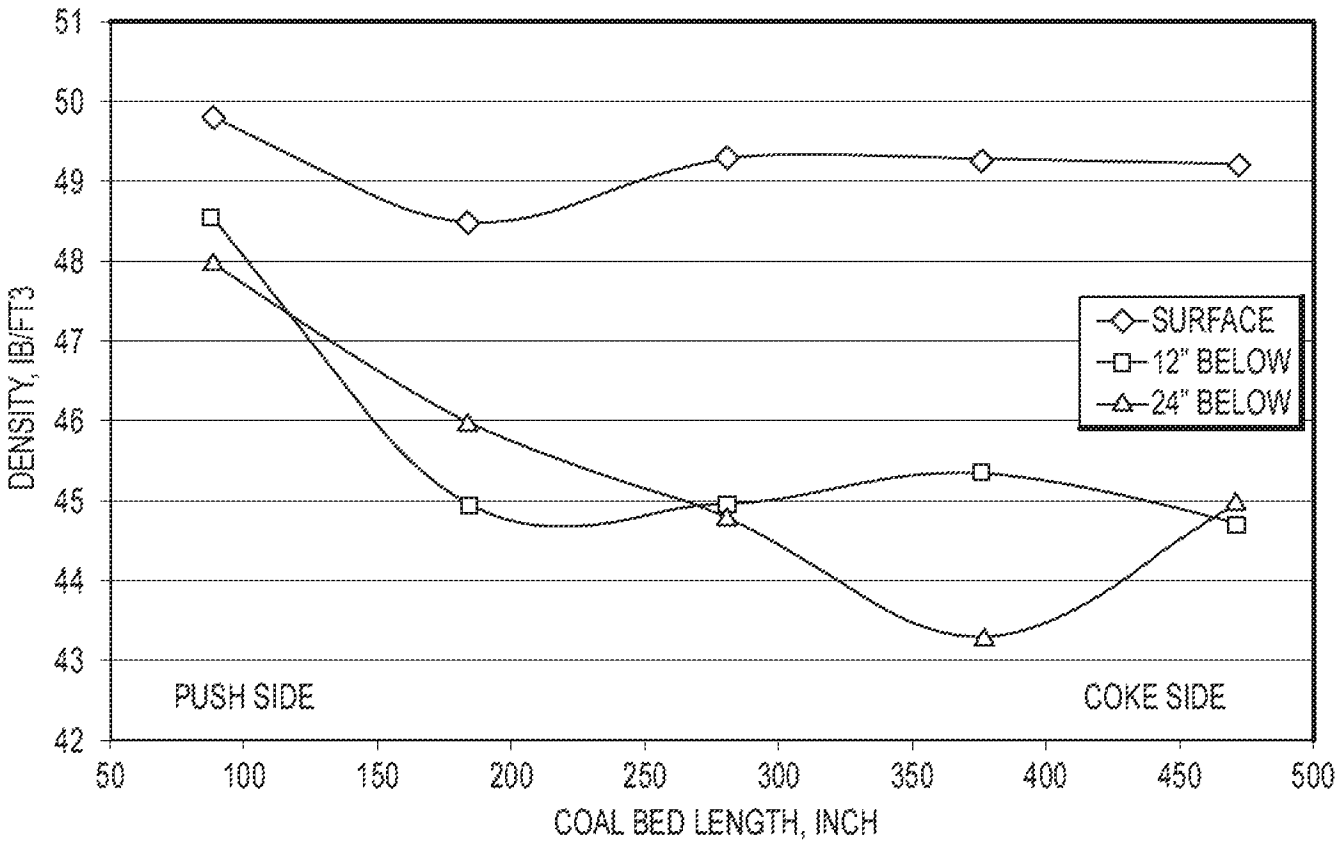
FIG. 6 depicts a plot of test data of surface and internal coal bulk density over bed length.
Figure 7:
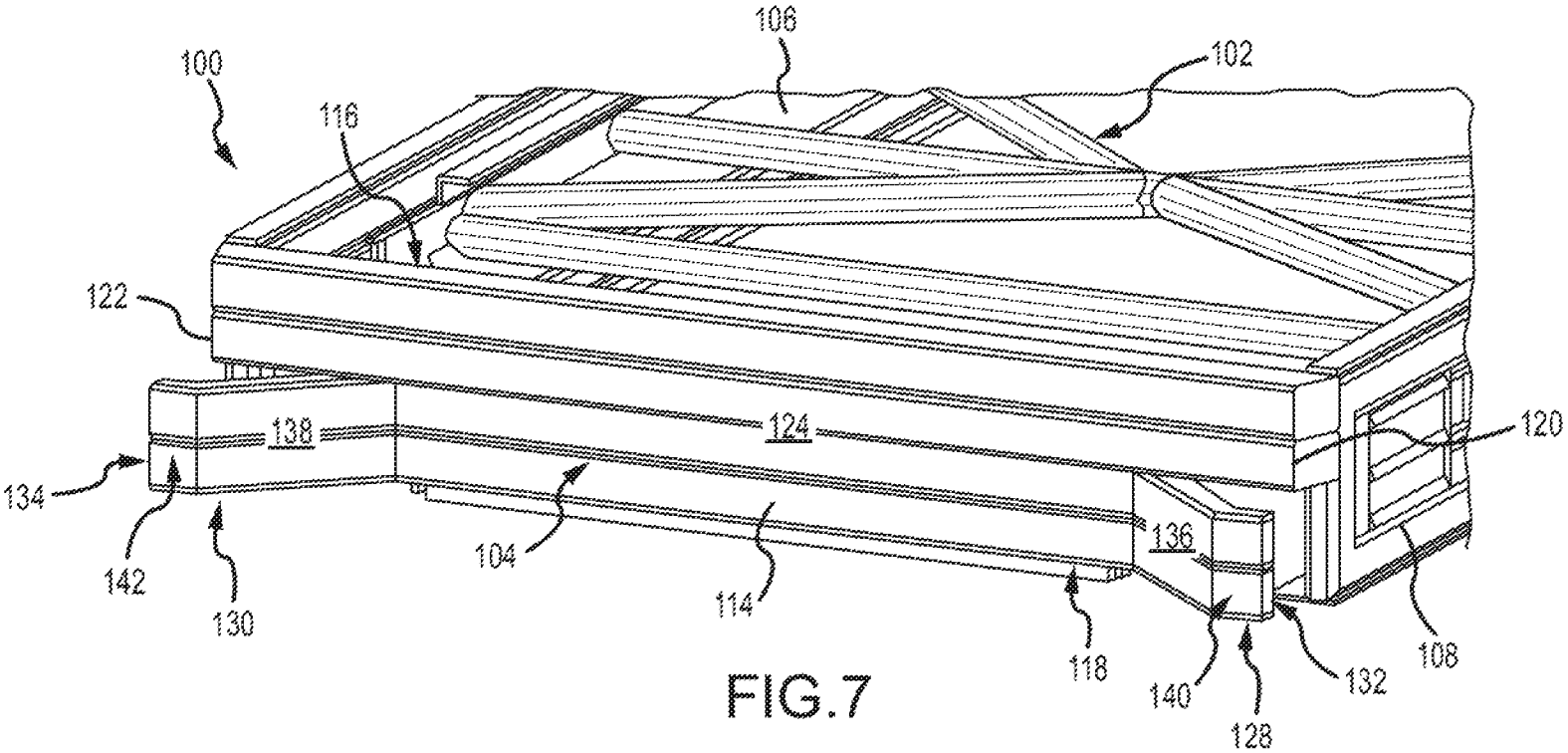
FIG. 7 depicts a front, perspective view of one embodiment of a charging frame and charging head of a coal charging system according to the present technology.
Figure 8:
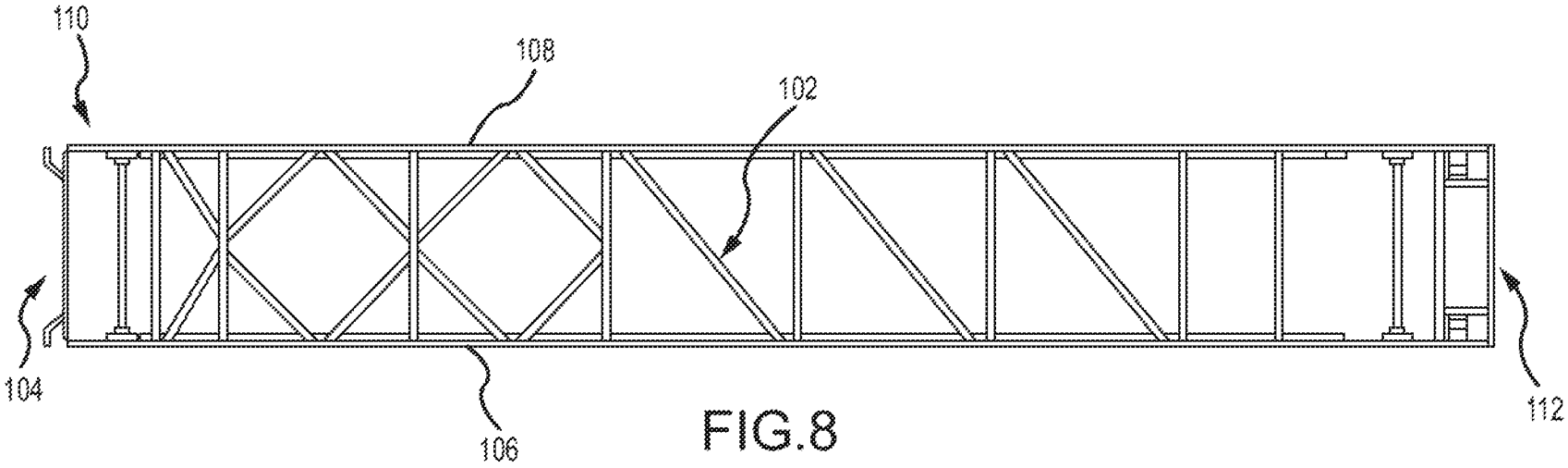
FIG. 8 depicts a top, plan view of the charging frame and charging head depicted in FIG. 7.

Many prior coal charging systems provide a minor amount of compaction on the coal bed surface due to the weight of the charging head and charging frame. However, the compaction is typically limited to twelve inches below the surface of the coal bed. Data during coal bed testing demonstrated that the bulk density measurement in this region to be a three to ten unit point difference inside the coal bed. FIG. 6 graphically depicts density measurements taken during mock oven testing. The top line shows the density of the coal bed surface. The lower two lines depict the density at twelve inches and twenty-four inches below the coal bed surface, respectively. From the testing data, one can conclude that bed density drops more significantly on the coke side of the oven.

With reference to FIGS. 21-29, various embodiments of the present technology position one or more extrusion plates 166 operatively coupled with the rearward face 126 of the charging head 104. In some embodiments, the extrusion plate 166 includes a coal engagement face 168 that is oriented to face rearwardly and downwardly with respect to the charging head 104. In this manner, loose coal being charged into the oven behind the charging head 104 will engage the coal engagement face 168 of the extrusion plate 166. Due to the pressure of the coal being deposited behind the charging head 104, the coal engagement face 168 compacts the coal downwardly, increasing the coal density of the coal bed beneath the extrusion plate 166. In various embodiments, the extrusion plate 166 extends substantially along a length of the charging head 104 in order to maximize density across a significant width of the coal bed. With continued reference to FIGS. 21 and 22, the extrusion plate 166 further includes an upper deflection face 170 that is oriented to face rearwardly and upwardly with respect to the charging head 104. In this manner, the coal engagement face 168 and the upper deflection face 170 are coupled with one another to define a peak shape, having a peak ridge that faces rearwardly away from the charging head 104. Accordingly, any coal that falls atop the upper deflection face 170 will be directed off the extrusion plate 166 to join the incoming coal before it is extruded.

Figure 23:
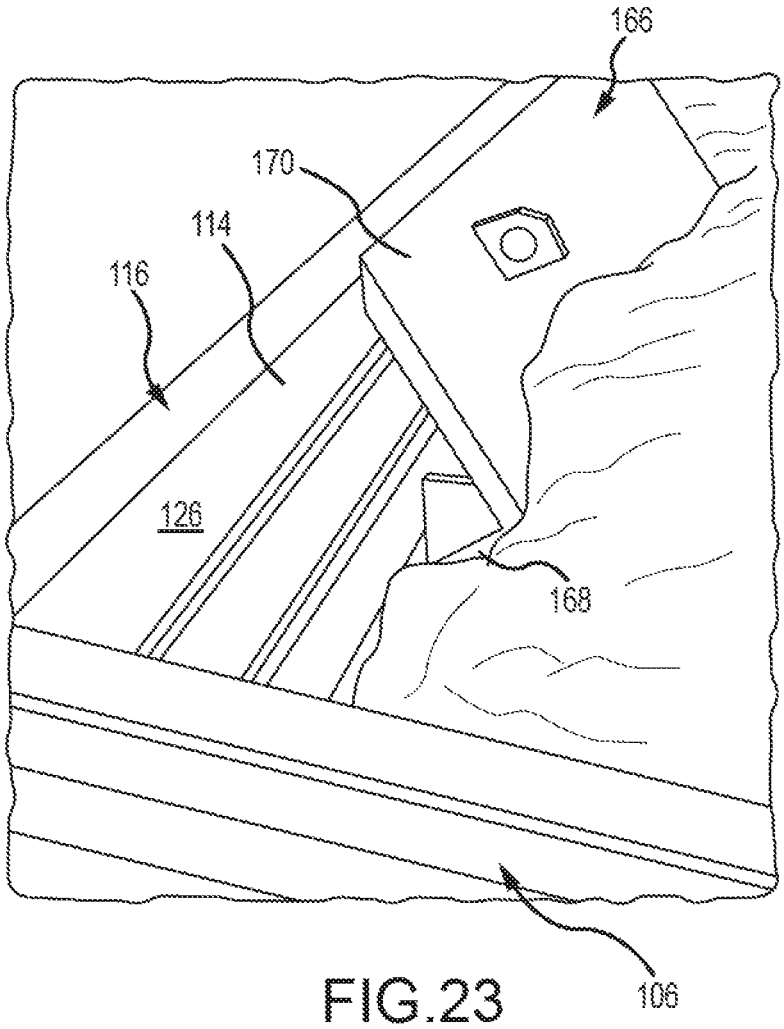
FIG. 23 depicts a side perspective view of one embodiment of an extrusion plate, according to the present technology, and further depicts one manner in which it may be associated with a rearward face of a charging head and extrude coal that is being conveyed into a coal charging system.

In use, coal is shuffled to the front end portion of the coal charging system 100, behind the charging head 104. Coal piles up in the opening between the conveyor and the charging head 104 and conveyor chain pressure starts to build up gradually until reaching approximately 2500 to 2800 psi. With reference to FIG. 23, the coal is fed into the system behind the charging head 104 and the charging head 104 is retracted, rearwardly through the oven. The extrusion plate 166 compacts the coal and extrudes it into the coal bed.

Figure 24A:
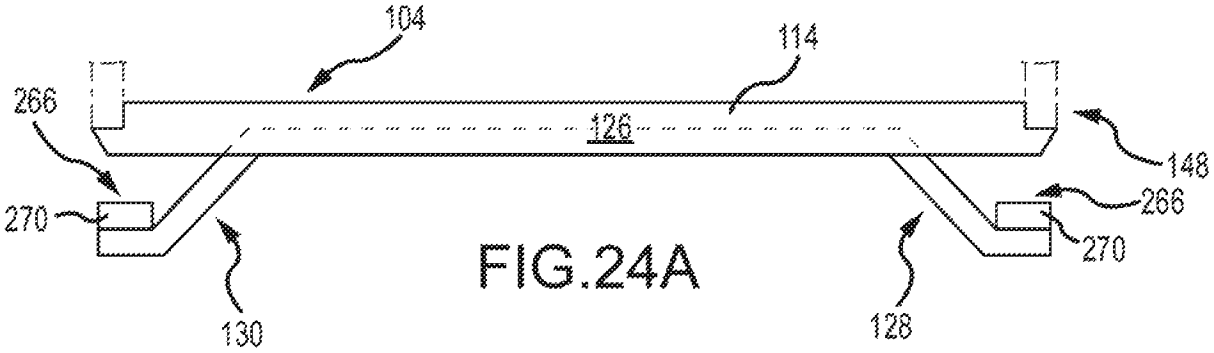
FIG. 24A depicts a top plan view of another embodiment of extrusion plates, according to the present technology, and further depicts one manner in which they may be associated with wing members of a charging head.
Figure 24B:
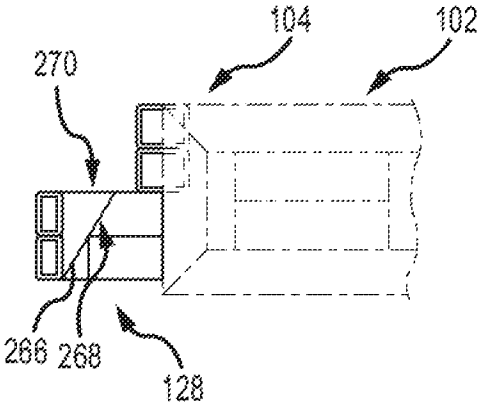
FIG. 24B depicts a side elevation view of the extrusion plates of FIG. 24A.
Figure 25A:
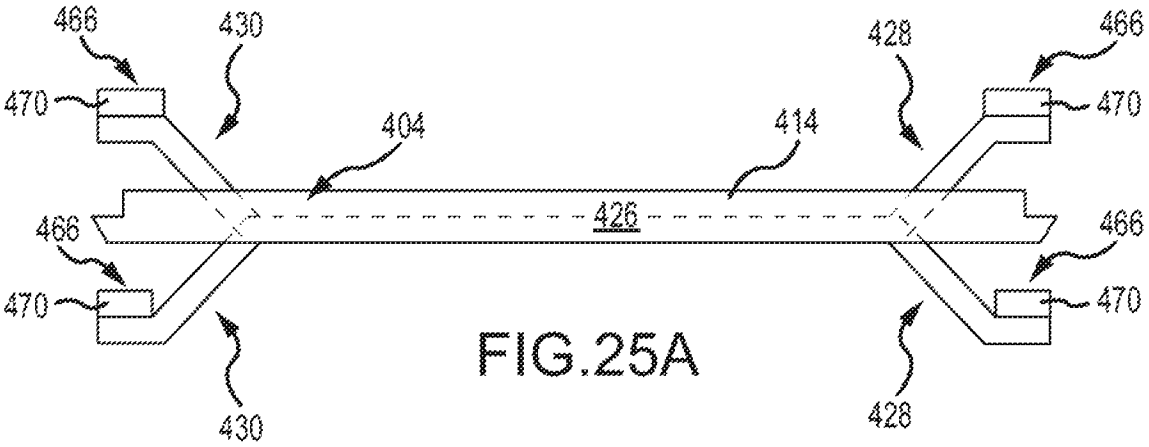
FIG. 25A depicts a top plan view of still another embodiment of extrusion plates, according to the present technology, and further depicts one manner in which they may be associated with multiple sets of wing members that are disposed both forwardly and rearwardly of a charging head.
Figure 25B:
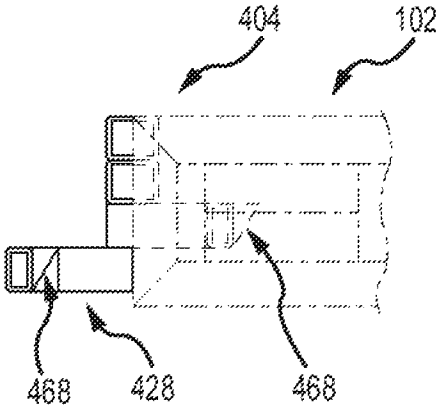
FIG. 25B depicts a side elevation view of the extrusion plates of FIG. 25A.

With reference to FIGS. 24A-25B, embodiments of the present technology may associate extrusion plates with one or more wings that extend from the charging head. FIGS. 24A and 24B depict one such embodiment where extrusion plates 266 extend rearwardly from opposing wings 128 and 130. In such embodiments, the extrusion plates 266 are provided with coal engagement faces 268 and upper deflection faces 270 that are coupled with one another to define a peak shape, having a peak ridge that faces rearwardly away from the opposing wings 128 and 130. The coal engagement faces 268 are positioned to compact the coal downwardly as the coal charging system is retracted through the oven, increasing the coal density of the coal bed beneath the extrusion plates 266. FIGS. 25A and 25B depict a charging head similar to that depicted in FIGS. 12A-12C except that extrusion plates 466, having coal engagement faces 468 and upper deflection faces 470, are positioned to extend rearwardly from the opposing wings 428 and 430. The extrusion plates 466 function similarly to the extrusion plates 266. Additional extrusion plates 466 may be positioned to extend forwardly from the opposing wings 444 and 446, which are positioned behind the charging head 400. Such extrusion plates compact the coal downwardly as the coal charging system is advanced through the oven, further increasing the coal density of the coal bed beneath the extrusion plates 466.

Figure 26:
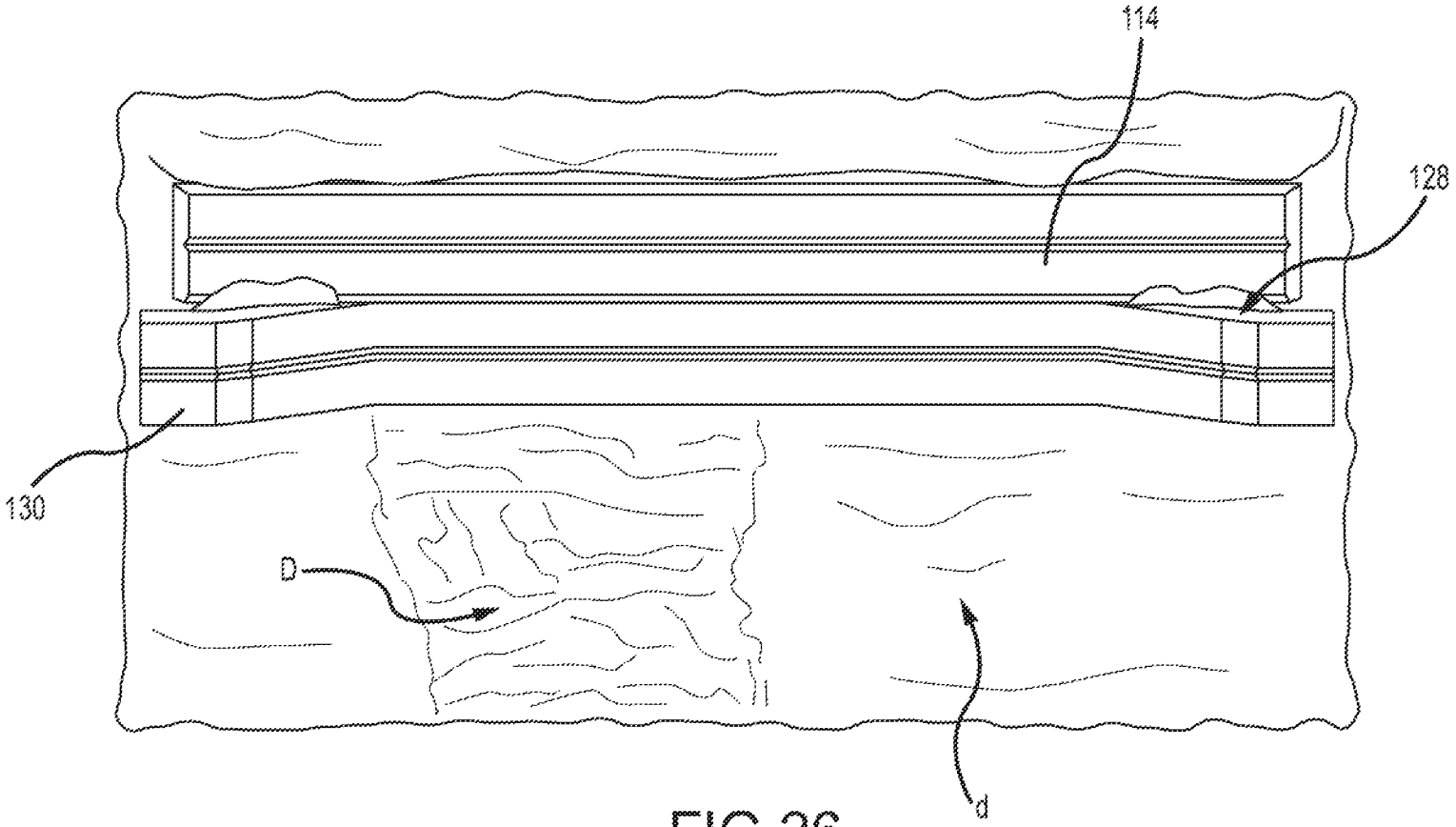
FIG. 26 depicts a front elevation view of one embodiment of a charging head, according to the present technology, and further depicts the differences in coal bed densities when an extrusion plate is used and not used in a coal bed charging operation.
Figure 27:
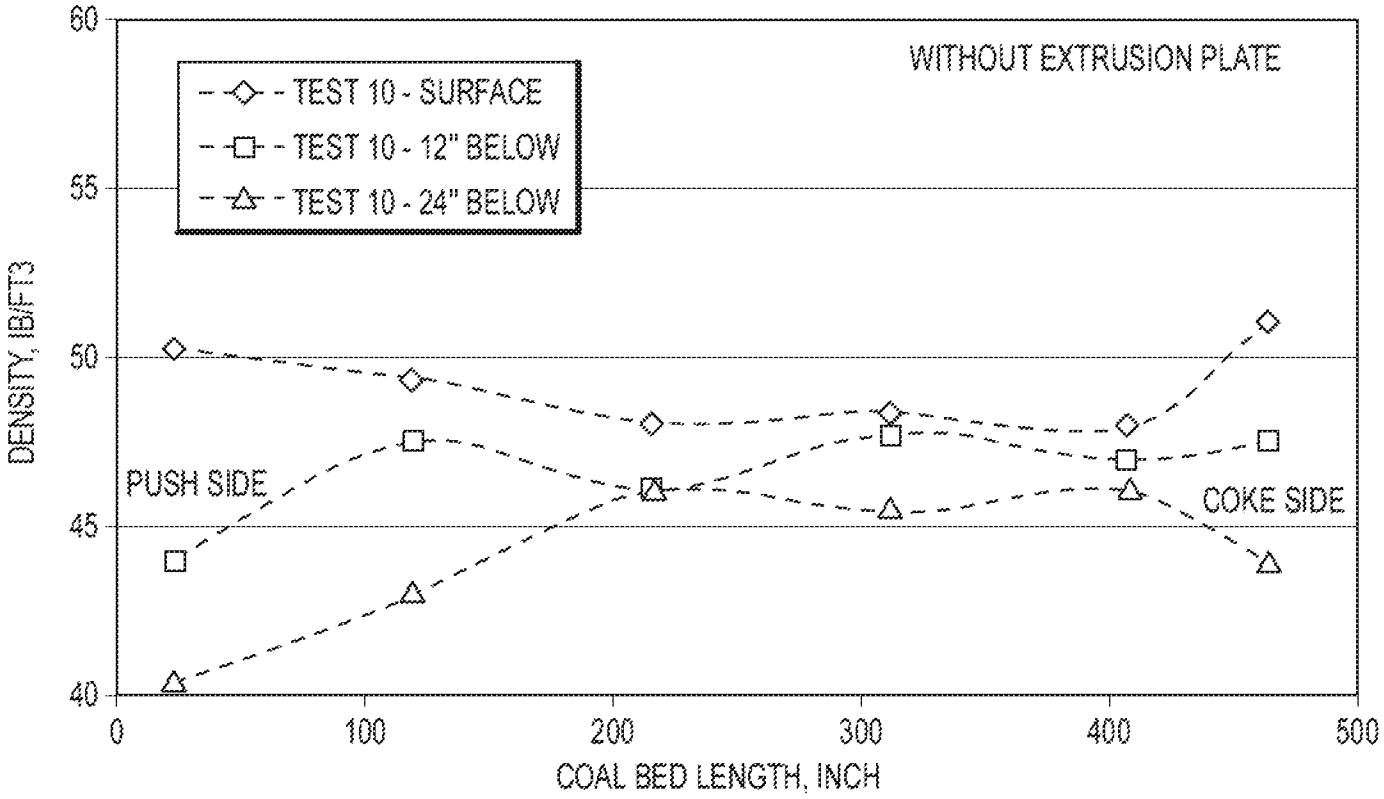
FIG. 27 depicts a plot of coal bed density over a length of a coal bed where the coal bed is charged without the use of an extrusion plate.
Figure 28:
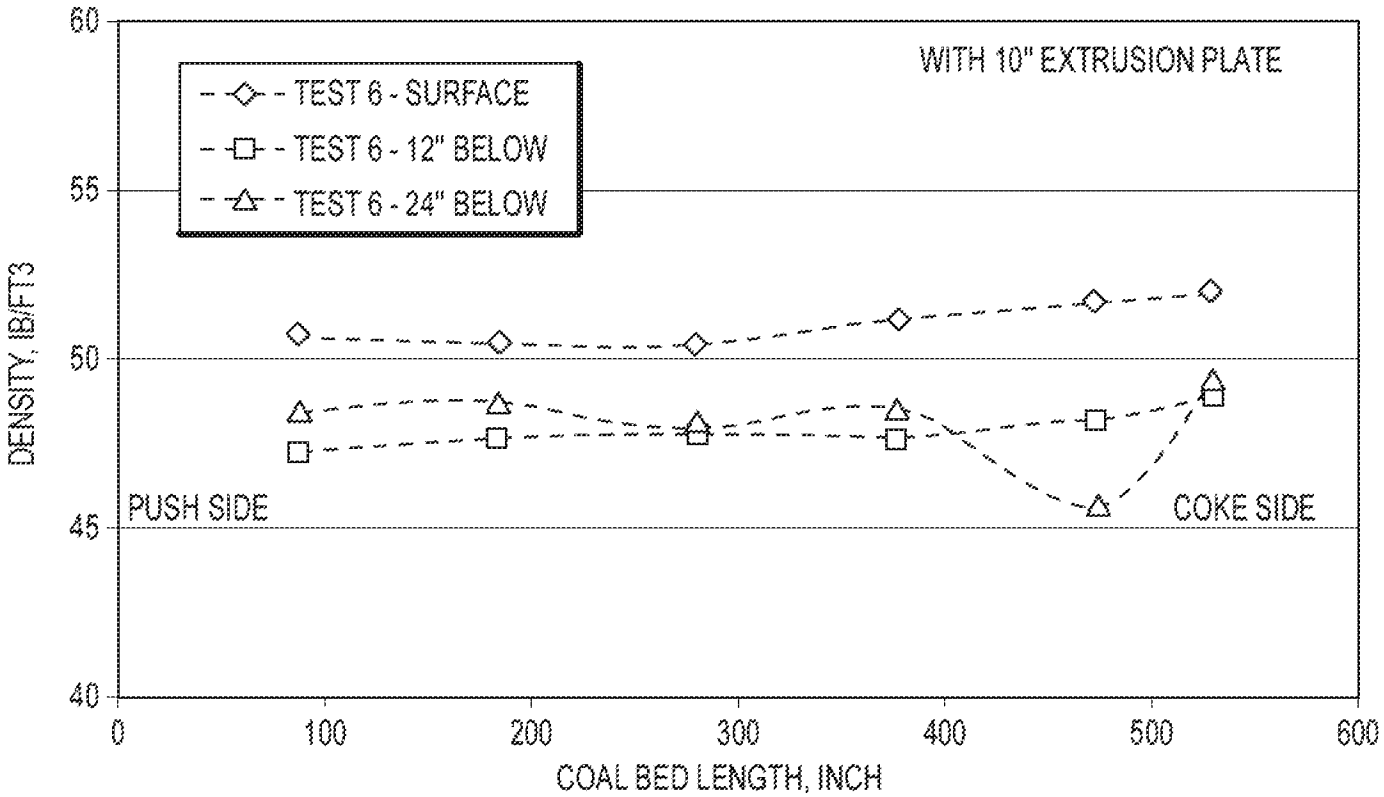
FIG. 28 depicts a plot of coal bed density over a length of a coal bed where the coal bed is charged with the use of an extrusion plate.

FIG. 26 depicts the effect on the density of a coal charge with the benefit of the extrusion plate 166 (left side of the coal bed) and without the benefit of the extrusion plate 166 (right side of the coal bed). As depicted, use of the extrusion plate 166 provides area "D" of increased coal bed bulk density and an area of lesser coal bed bulk density "d" where the extrusion plate is not present. In this manner, the extrusion plate 166 not only demonstrates an improvement in the surface density, but also improves the overall internal bed bulk density. The test results, depicted in FIGS. 27 and 28 below, show the improvement of bed density with the use of the extrusion plate 166 (FIG. 28) and without the use of the extrusion plate 166 (FIG. 27). The data demonstrates a significant impact on both surface density and twenty-four inches below the surface of the coal bed. In some testing, an extrusion plate 166 having a ten inch peak (distance from back of the charging head 104 to the peak ridge of the extrusion plate 166, where the coal engagement face 168 and the upper deflection face 170 meet). In other tests, where a six inch peak was used, coal density was increased but not to the levels resulting from the use of the ten inch peak extrusion plate 166. The data reveals that the use of the ten inch peak extrusion plate increased the density of the coal bed, which allowed for an increase in charge weight of approximately two and a half tons. In some embodiments of the present technology, it is contemplated that smaller extrusion plates, of five to ten inches in peak height for example, or larger extrusion plates, of ten to twenty inches in peak height for example, could be used.

Figure 29:
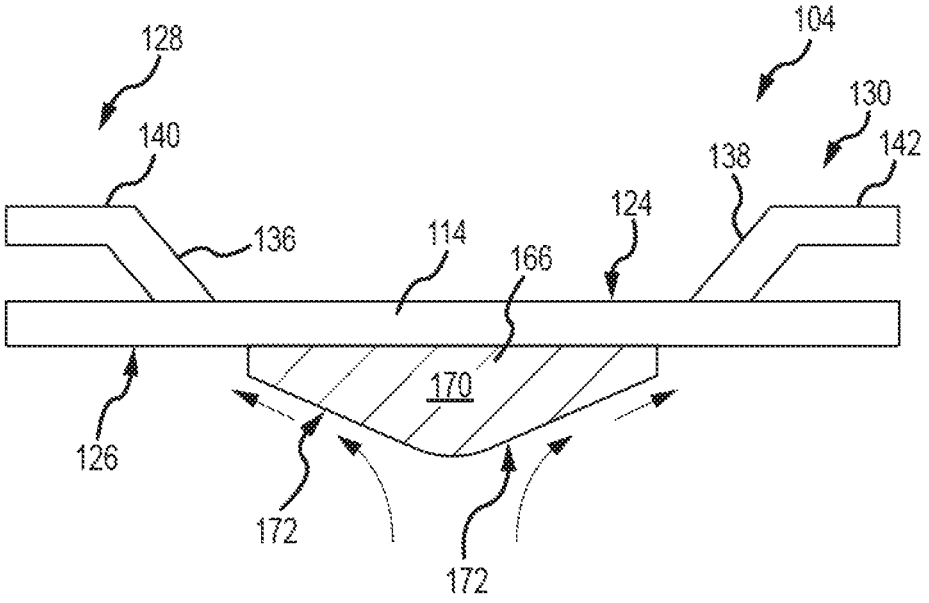
FIG. 29 depicts a top plan view of one embodiment of a charging head, according to the present technology, and further depicts another embodiment of an extrusion plate that may be associated with a rearward surface of the charging head.

With reference to FIG. 29, other embodiments of the present technology provide an extrusion plate 166 that is shaped to include opposing side deflection faces 172 that are oriented to face rearwardly and laterally with respect to the charging head 104. By shaping the extrusion plate 166 to include the opposing side deflection faces 172, testing showed that more extruded coal flowed toward both sides of the bed while it was extruded. In this manner, extrusion plate 166 helps to promote the level coal bed, depicted in FIG. 2B, as well as an increase in coal bed density across the width of the coal bed.

Figure 5:
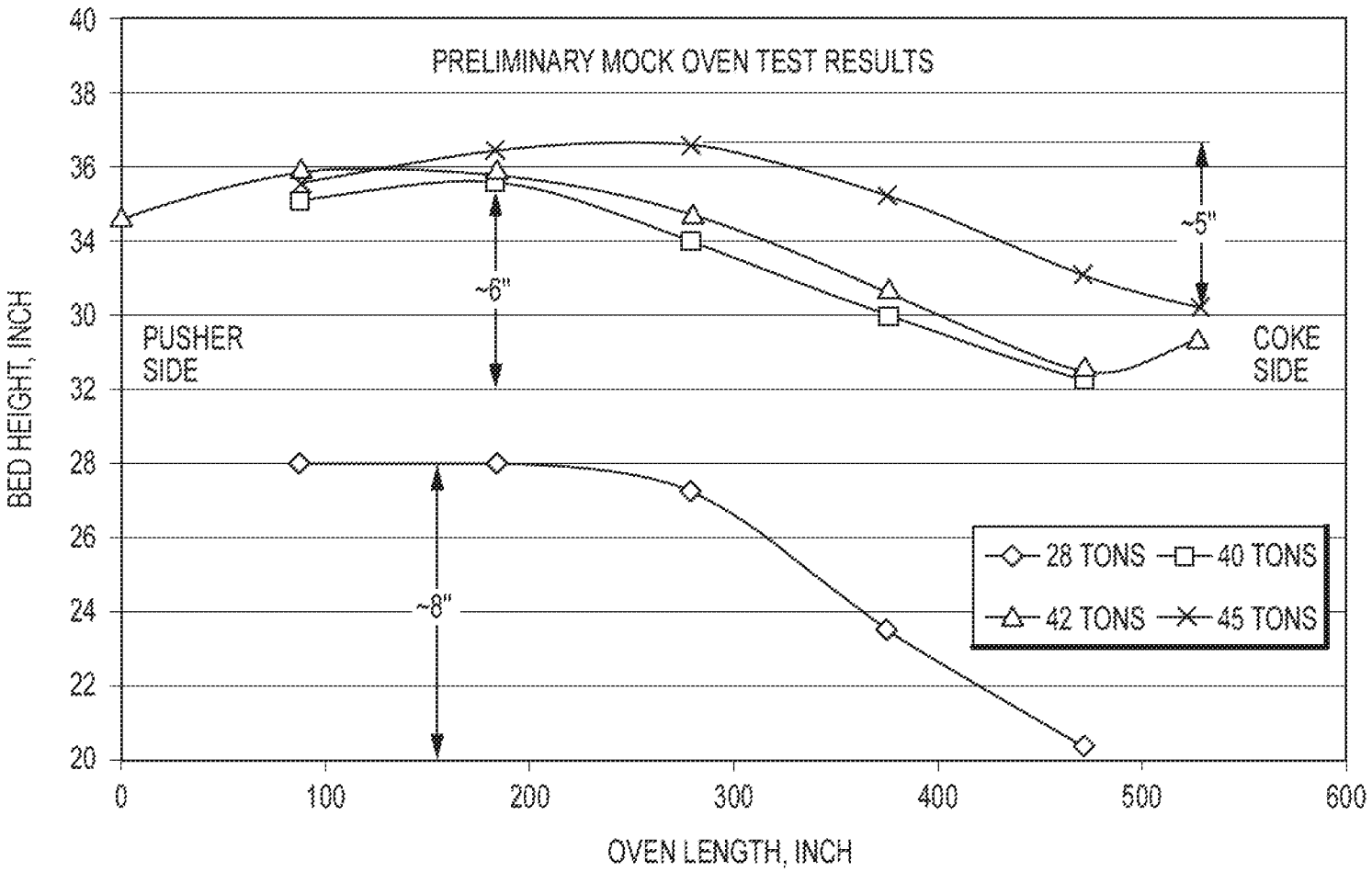
FIG. 5 depicts a plot of mock data of bed height over bed length and the bed height drop, due to coal charging system deflection.

When charging systems extend inside the ovens during charging operations, the coal charging systems, typically weighing approximately 80,000 pounds, deflect downwardly at their free, distal ends. This deflection shortens the coal charge capacity. FIG. 5 shows that the bed height drop, due to coal charging system deflection, is from five inches to eight inches between the pusher side to the coke side, depending upon the charge weight. In general, coal charging system deflection can cause a coal volume loss of approximately 1 to 2 tons. During a charging operation, coal piles up in the opening between the conveyor and the charging head 104 and conveyor chain pressure starts to build up. Traditional coal charging systems operate at a chain pressure of approximately 2300 psi. However, the coal charging system of the present technology can be operated at a chain pressure of approximately 2500 to 2800 psi. This increase in chain pressure increases the rigidity of the coal charging system 100 along a length of its charging frame 102. Testing indicates that operating the coal charging system 100 at a chain pressure of approximately 2700 psi reduces deflection of the coal charging system deflection by approximately two inches, which equates to a higher charge weight and increased production. Testing has further shown that operating the coal charging system 100 at a higher chain pressure of approximately 3000 to 3300 psi can produce a more effective charge and further realize greater benefit from the use of one or more extrusion plates 166, as described above.

EXAMPLES

The following Examples are illustrative of several embodiments of the present technology.

1. A coal charging system, the system comprising:
   an elongated charging frame having a distal end portion, proximal end portion, and opposite sides; and
   a charging head operatively coupled with the distal end portion of the elongated charging frame; the charging head including a planar body residing within a charging head plane and having an upper edge portion, lower edge portion, opposite side portions, a front face, and a rearward face;
   the charging head further including a pair of opposing wings having free end portions positioned in a spaced-apart relationship from the charging head, defining open spaces that extend from inner faces of the opposing wings through the charging head plane.

2. The coal charging system of claim 1 wherein the opposing wings are positioned to extend forwardly from the charging head plane.

3. The coal charging system of claim 1 wherein the opposing wings are positioned to extend rearwardly from the charging head plane.

4. The coal charging system of claim 1 further comprising:
   a pair of second opposing wings having free end portions positioned in a spaced-apart relationship from the charging head, defining open spaces that extend from inner faces of the opposing wings through the charging head plane;
   the second opposing wings extending from the charging head in a direction opposite to a direction in which the other opposing wings extend from the charging head.

5. The coal charging system of claim 1 wherein the opposing wings include a first face adjacent the charging head plane and a second face extending from the first face toward the free end portion.

6. The coal charging system of claim 5 wherein the second faces of the opposing wings reside within a wing plane that is parallel to the charging head plane.

7. The coal charging system of claim 6 wherein each of the first faces of the opposing wings are angularly disposed from the charging head plane toward adjacent sides of the charging head.

8. The coal charging system of claim 7 wherein each of the first faces of the opposing wings are angularly disposed at a forty-five degree angle from the charging head plane toward adjacent sides of the charging head.

9. The coal charging system of claim 1 wherein the opposing wings are angularly disposed from the charging head plane toward adjacent sides of the charging head.

10. The coal charging system of claim 9 wherein the opposing wings each have opposite end portions and extend along a straight pathway between the opposite end portions.

11. The coal charging system of claim 9 wherein the opposing wings each have opposite end portions and extend along a curvilinear pathway between the opposite end portions.

12. The coal charging system of claim 1 further comprising:
   at least one angularly disposed particulate deflection surface on top of the upper edge portion of the charging head.

13. The coal charging system of claim 1 further comprising:
   at least one particulate deflection surface on top of the upper edge portion of the charging head; the particulate deflection surface being shaped such that a substantial portion of the particulate deflection surface is not horizontally disposed.

14. The coal charging system of claim 1 further comprising:
   an elongated densification bar extending along a length of, and downwardly from, each of the opposing wings.

15. The coal charging system of claim 14 wherein the elongated densification bar has a long axis disposed at an angle with respect to the charging head plane.

16. The coal charging system of claim 14 wherein the densification bar is comprised of a curvilinear lower engagement face that is coupled with each of the opposing wings in a static position.

17. The coal charging system of claim 1 wherein a portion of each of the opposite side portions of the charging head are angularly disposed from the front face of the charging head toward the rearward face to define generally forward facing charging head deflection faces.

18. The coal charging system of claim 1 wherein the charging head is coupled to the elongated charging frame by a plurality of slotted joints that allow relative movement between the charging head and the elongated charging frame.

19. The coal charging system of claim 1 wherein each of the opposite sides of the elongated charging frame include charging frame deflection faces, positioned to face at a downward angle toward a middle portion of the charging frame.

20. The coal charging system of claim 1 wherein each of the opposite sides of the elongated charging frame include charging frame deflection faces, positioned to face at a downward angle toward the charging frame.

21. The coal charging system of claim 1 wherein forward end portions of each of the opposite sides of the elongated charging frame include charging frame deflection faces, positioned rearwardly from the wings, and oriented to face forwardly and outwardly from the sides of the elongated charging frame.

22. The coal charging system of claim 1 further comprising:
   an extrusion plate operatively coupled with the rearward face of the charging head; the extrusion plate having a coal engagement face that is oriented to face rearwardly and downwardly with respect to the charging head.

23. The coal charging system of claim 22 wherein the extrusion plate extends substantially along a length of the charging head.

24. The coal charging system of claim 22 wherein the extrusion plate further includes an upper deflection face that is oriented to face rearwardly and upwardly with respect to the charging head; the coal engagement face and deflection face being operatively coupled with one another to define a peak shape, having a peak ridge that faces rearwardly away from the charging head.

25. The coal charging system of claim 22 wherein the extrusion plate is shaped to include opposing side deflection faces that are oriented to face rearwardly and laterally with respect to the charging head.

26. The coal charging system of claim 1 further comprising:

an extrusion plate operatively coupled with a rearward face of each of the opposing wings; the extrusion plates each having a coal engagement face that is oriented to face rearwardly and downwardly with respect to the wings.

27. The coal charging system of claim 1 further comprising:

an extrusion plate operatively coupled with a rearward face of each of the opposing wings and second opposing wings; the extrusion plates each having a coal engagement face that is oriented to face rearwardly and downwardly with respect to the wings.

28. A coal charging system, the system comprising:

an elongated charging frame having a distal end portion, proximal end portion, and opposite sides; and a charging head operatively coupled with the distal end portion of the elongated charging frame; the charging head including a planar body residing within a charging head plane and having an upper edge portion, lower edge portion, opposite side portions, a front face, and a rearward face;

an extrusion plate operatively coupled with the rearward face of the charging head; the extrusion plate having a coal engagement face that is oriented to face rearwardly and downwardly with respect to the charging head.

29. The coal charging system of claim 28 wherein the extrusion plate extends substantially along a length of the charging head.

30. The coal charging system of claim 28 wherein the extrusion plate further includes an upper deflection face that is oriented to face rearwardly and upwardly with respect to the charging head; the coal engagement face and deflection face being operatively coupled with one another to define a peak shape, having a peak ridge that faces rearwardly away from the charging head.

31. The coal charging system of claim 28 wherein the extrusion plate is shaped to include opposing side deflection faces that are oriented to face rearwardly and laterally with respect to the charging head.

32. A method of charging coal into a coke oven, the method comprising:

positioning a coal charging system, having an elongated charging frame and a charging head operatively coupled with the distal end portion of the elongated charging frame, at least partially within a coke oven;

conveying coal into the coal charging system closely adjacent a rearward surface of the charging head;

moving the coal charging system along a long axis of the coke oven so that a portion of the coal flows through a pair of opposing wing openings that penetrate lower side portions of the charging head and engage a pair of opposing wings having free end portions positioned in a spaced-apart relationship from a charging head plane of the charging head, such that the portion of the coal is directed toward side portions of a coal bed being formed by the coal charging system.

33. The method of claim 32 further comprising:

compressing portions of the coal bed beneath the opposing wings by engaging elongated densification bars, which extend along a length of, and downwardly from, each of the opposing wings, with the portions of the coal bed as the coal charging system is moved.

34. The method of claim 32 further comprising:

extruding at least portions of the coal being conveyed into the coal charging system by engaging the portions of the coal with an extrusion plate operatively coupled with a rearward face of the charging head, such that the portions of coal are compressed beneath a coal engagement face that is oriented to face rearwardly and downwardly with respect to the charging head.

35. The method of claim 34 wherein the extrusion plate is shaped to include opposing side deflection faces that are oriented to face rearwardly and laterally with respect to the charging head and portions of the coal are extruded by the opposing side deflection faces.

36. The method of claim 32 further comprising:

moving the coal charging system along a long axis of the coke oven in a second, opposite direction so that a portion of the coal flows through a pair of second opposing wing openings that penetrate lower side portions of the charging head and engage a pair of second opposing wings having free end portions positioned in a spaced-apart relationship from a charging head plane of the charging head, such that the portion of the coal is directed toward side portions of a coal bed being formed by the coal charging system;

the second opposing wings extending from the charging head in a direction opposite to a direction in which the other opposing wings extend from the charging head.

37. A method of charging coal into a coke oven, the method comprising:

positioning a coal charging system, having an elongated charging frame and a charging head operatively coupled with the distal end portion of the elongated charging frame, at least partially within a coke oven;

conveying coal into the coal charging system closely adjacent a rearward surface of the charging head;

gradually moving the coal charging system along a long axis of the coke oven so that a portion of the coal is extruded by engaging the portions of the coal with an extrusion plate operatively coupled with a rearward face of the charging head, such that the portions of coal are compressed beneath a coal engagement face that is oriented to face rearwardly and downwardly with respect to the charging head.

38. The method of claim 37 wherein the extrusion plate is shaped to include opposing side deflection faces that are oriented to face rearwardly and laterally with respect to the charging head and portions of the coal are extruded by the opposing side deflection faces.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

We claim:

1. A coal charging system, the system comprising:

an elongated charging frame having a distal end portion, proximal end portion, and opposite sides;

a charging head operatively coupled with the distal end portion of the elongated charging frame; the charging head including a planar body residing within a charging head plane and having an upper edge portion, lower edge portion, opposite side portions, a front face, and a rearward face;

an extrusion plate operatively coupled with the rearward face of the charging head; the extrusion plate having a coal engagement face that is oriented to face rearwardly and downwardly with respect to the charging head; and a charging conveyor operatively coupled with the elongated charging frame and having a distal end positioned adjacent the coal engagement face of the extrusion plate so that coal is deposited into an opening, which extends, unimpeded, from the distal end of the charging conveyor to the coal engagement face of the extrusion plate; the distal end of the charging conveyor further being positioned so that the coal engages the coal engagement face and increases a charging pressure, such that the extrusion plate extrudes and compacts the coal from the opening into a coal bed.

2. The coal charging system of claim 1 wherein the extrusion plate extends substantially along a length of the charging head.

3. The coal charging system of claim 1 wherein the extrusion plate further includes an upper deflection face that is oriented to face rearwardly and upwardly with respect to the charging head; the coal engagement face and deflection face being operatively coupled with one another to define a peak shape, having a peak ridge that faces rearwardly away from the charging head.

4. The coal charging system of claim 1 wherein the extrusion plate is shaped to include opposing side deflection faces that are oriented to face rearwardly and laterally with respect to the charging head.

5. A method of charging coal into a coke oven, the method comprising:

positioning a coal charging system, having an elongated charging frame, a charging head operatively coupled with the distal end portion of the elongated charging frame, and an extrusion plate operatively coupled with a reward face of the charging head, the extrusion plate having a coal engagement face oriented rearwardly and downwardly with respect to the charging head, at least partially within a charging opening of a coke oven;

conveying coal into the coal charging system and into an opening extending, unimpeded, from the distal end of the charging conveyor to the coal engagement face of the extrusion plate so that the coal piles up in the opening and engages the coal engagement face of the extrusion plate;

extruding at least a portion of the coal by continuing to convey coal into the opening and against the coal engagement face of the extrusion plate, causing a charging pressure to increase, compacting the coal and extruding it into a coal bed; and gradually moving the coal charging system along a long axis of the coke oven.

6. The method of claim 5 wherein the extrusion plate is shaped to include opposing side deflection faces that are oriented to face rearwardly and laterally with respect to the charging head and portions of the coal are extruded by the opposing side deflection faces.

7. The method of claim 5 wherein the charging pressure includes a conveyor chain pressure that is maintained above 2300 psi.

8. The method of claim 5 wherein the charging pressure includes a conveyor chain pressure that is maintained between 2500 psi and 2800 psi.

9. The method of claim 5 wherein the charging pressure includes a conveyor chain pressure that is maintained between 3000 psi and 3300 psi.

10. The method of claim 5 wherein the charging pressure includes a conveyor chain pressure that is maintained at a level that increases the rigidity of the coal charging system and reduces a deflection of the coal charging system.

* * * * *